US007187876B2

(12) United States Patent
Ito et al.

(10) Patent No.: US 7,187,876 B2
(45) Date of Patent: Mar. 6, 2007

(54) IMAGE FORMING APPARATUS WITH MECHANISM TO CONTROL TONER REPLENISHMENT

(75) Inventors: Junichi Ito, Tokyo (JP); Tetsu Koyama, Tokyo (JP); Shinichi Otani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/973,470

(22) Filed: Oct. 27, 2004

(65) Prior Publication Data

US 2005/0117919 A1 Jun. 2, 2005

(30) Foreign Application Priority Data

Nov. 27, 2003 (JP) ..... 2003-397097
Feb. 6, 2004 (JP) ..... 2004-030875

(51) Int. Cl.
*G03G 15/08* (2006.01)

(52) U.S. Cl. ..... 399/27; 399/258; 399/260; 399/262

(58) Field of Classification Search ..... 399/27, 399/58–65, 252, 258, 260, 262; 222/DIG. 1
See application file for complete search history.

(56) References Cited

U.S. PATENT DOCUMENTS 4,142,655 A 3/1979 Fantuzzo
5,329,340 A * 7/1994 Fukuchi et al. ..... 399/254
6,021,294 A 2/2000 Schmidl et al.

FOREIGN PATENT DOCUMENTS

| | | |
|---|---|---|
| EP | 0 514 874 A2 | 11/1992 |
| EP | 0 807 866 A1 | 11/1997 |
| JP | 2001-125358 | 5/2001 |
| JP | 2001-255727 | 9/2001 |
| JP | 2002-072657 | 3/2002 |

* cited by examiner

*Primary Examiner*—Hoang Ngo
(74) *Attorney, Agent, or Firm*—Rabin & Berdo, P.C.

(57) ABSTRACT

An image-forming apparatus includes a mechanism that controls the replenishment amount of toner to a predetermined value. A toner cartridge holds toner therein. The toner cartridge is detachably attached to a process cartridge. The process cartridge has a toner reservoir that holds the toner supplied from the toner cartridge, a photoconductive drum and a developing roller that supplies the toner to the photoconductive drum. A valve is located between the toner cartridge and the process cartridge and supplies the toner from the toner cartridge to the process cartridge. When the valve rotates, the valve supplies a volume of toner in such a way that the toner in the toner reservoir fills a volume not more than a predetermined fraction of a maximum capacity of the toner reservoir.

19 Claims, 21 Drawing Sheets

IMAGE FORMING APPARATUS WITH MECHANISM TO CONTROL TONER REPLENISHMENT

BACKGROUND OF THE INVENTION

1. Field of the Invention

The present invention relates to an image-forming apparatus.

2. Description of the Related Art

A conventional electrophotographic image-forming apparatus such as a printer, a facsimile machine, and a copying machine is equipped with an image-forming section. The image-forming section has a toner reservoir to which a toner cartridge is attached. The toner cartridge holds toner therein and supplies the toner into the toner reservoir. When the remaining amount of toner in the image-forming section is not sufficient or the density of printed images is not sufficient, the toner is supplied from the toner cartridge into the image-forming section.

The image-forming-section includes an agitator that is rotatably supported in the toner reservoir and agitates the toner in the toner reservoir.

With the aforementioned conventional image-forming apparatus, when the toner held in the image-forming section is agitated, the toner deteriorates gradually. It is not desirable for the image-forming section to hold a remaining amount of toner more than necessary. When the toner deteriorates, the charging characteristic of the toner becomes poor, preventing the toner from being charged sufficiently. As a result, insufficiently charged toner particles cling to the background of an electrostatic latent image formed on a photoconductive drum, leading to soiling of the surface of the photoconductive drum. This causes poor print quality.

If the image-forming section does not hold a sufficient amount of toner therein, the density of printed images becomes low or blurred (i.e., light and vague images), decreasing print quality.

SUMMARY OF THE INVENTION

An object of the invention is to solve the problems of the aforementioned conventional image-forming apparatus, and provides an image-forming apparatus that improves image quality.

An image-forming apparatus includes:

a first casing holding developer therein;

a second casing to which said first casing is detachably attached, said second casing having a developer reservoir that holds the developer supplied from said first casing, an image-bearing body and a developer-bearing body that supplies the developer to the image-bearing body;

a developer supplying member that is located between said first casing and said second casing and supplies the developer from said first casing to said second casing;

wherein when said developer-supplying member operates, said developer-supplying member supplies a volume of the developer in such a way that the developer in the developer reservoir is not more than a predetermined fraction of a maximum capacity of the developer reservoir.

The predetermined fraction is 80% of the maximum capacity of the developer reservoir.

The second casing has a detector that detects a remaining amount of developer held in the developer reservoir.

The detector is disposed at a position such that the detector detects a top of a pile of the developer when a remaining amount of the developer fills 80% of a total capacity of the developer reservoir.

The second casing includes a developer-agitating member that agitates the developer in the developer reservoir.

The developer-supplying member is selectively operatively coupled to the developer bearing body;

wherein when said developer-supplying member is coupled to the developer-bearing body, rotation of the developer-bearing body is transmitted to said developer-supplying member; and wherein when said developer-supplying member is not coupled to the developer-bearing body, rotation of the developer-bearing body is not transmitted to said developer-supplying member.

The when said developer-supplying member operates, said developer-supplying member supplies an amount of the developer at a rate not more than 10W, where W is an amount of the developer consumed when printing is performed on a print medium at a print duty of 100%.

The second casing has a detector that detects a remaining amount of developer in the developer reservoir.

The second casing includes a developer-agitating member that agitates the developer held in the developer reservoir.

The amount T of the developer is such that $2W \leqq T \leqq 10W$.

When said developer-supplying member operates, said developer-supplying member rotates to supply the developer by at least 100 mg for each complete rotation of said developer-supplying member.

The first casing has a developer-transporting member rotatably supported therein to transport the developer toward a middle portion of said first casing;

wherein the developer-transporting member is operatively coupled to said developer supplying member so that rotation of said developer supplying member is transmitted to the developer-transporting member.

The developer-supplying member extends in a longitudinal direction and has a plurality of vanes;

wherein the plurality of vanes extend in a direction substantially parallel to the longitudinal direction and in a direction transverse to the longitudinal direction to define, a developer-holding space between adjacent vanes.

The developer-holding space is in the relation that $$70 \leqq (Q2/Q1) \times 100$$

where Q2 is a sum of cross-sectional areas of the developer-holding space extending in a plane perpendicular to the longitudinal direction, and Q1 is a cross sectional area of a circular cylinder described by the plurality of vanes when said developer supplying member rotates about an axis parallel to the longitudinal direction.

The second casing has opposing walls that define an opening therebetween in which said developer supplying member is rotatably received with a gap not more than 2 mm between each one of the walls and the vanes.

The developer-holding space is one of a plurality of developer-holding spaces and at least one of the plurality of developer-holding spaces has a different cross sectional area from the other ones of the plurality of developer-holding spaces.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

The present invention will be described in detail with reference to the accompanying drawings.

Figure 1:
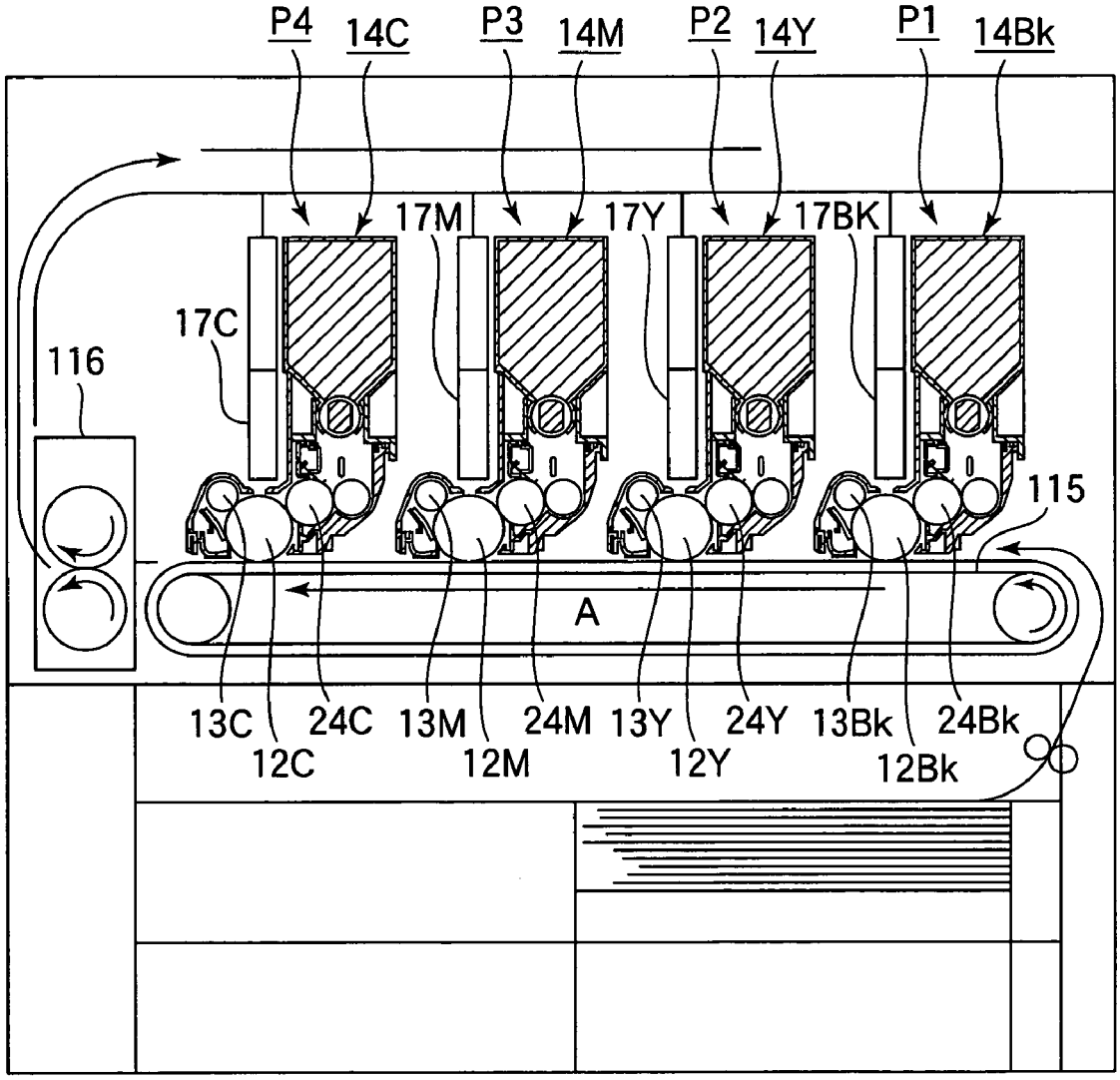
FIG. 1 is a schematic view of a printer according to a first embodiment.

FIG. 1 is a schematic view of a printer according to a first embodiment. Referring to FIG. 1, the printer includes image-forming mechanisms P1 to P4 that form black, yellow, magenta, and cyan images, respectively. The image-forming mechanisms P1 to P4 are aligned in a direction shown by arrow A in which a transfer belt (i.e., transport belt) 115 runs.

The image-forming mechanisms P1 to P4 include image-forming units 14BK, 14Y, 14M, and 14C and LED heads 17BK, 17Y, 17M, and 17C. The transfer rollers, not shown, oppose the image-forming units 14BK, 14Y, 14M, and 14C with the transfer belt 115 sandwiched between the image-forming units and the transfer rollers.

The image-forming units 14BK, 14Y, 14M, and 14C include photoconductive drums 12BK, 12Y, 12M, and 12C, charging rollers 13Bk, 13Y, 13M, and 13C, and developing rollers 24BK, 24Y, 24M, and 24C.

The charging rollers 13BK, 13Y, 13M, and 13C uniformly charge the entire surfaces of the photoconductive drums 12BK, 12Y, 12M, and 12C, respectively. The LED heads 17BK, 17Y, 17M, and 17C illuminate the charged surfaces of the corresponding photoconductive drums 12BK, 12Y, 12M, and 12C to form electrostatic latent images of corresponding colors. The developing rollers 24BK, 24Y, 24M, and 24C develop the electrostatic latent images with toners of corresponding colors into toner images.

The toner images of the respective colors are transferred one over the other onto paper by the transfer rollers. The print paper advances to a fixing unit 116 in which the toner images of the respective colors are fused into a permanent full color image.

The image-forming units 14BK, 14Y, 14M, and 14C are of the same configuration. For simplicity, only the operation of the image-forming unit 14BK for forming black images will be described, it being understood that the other image-forming units may work in a similar fashion.

Figure 2:
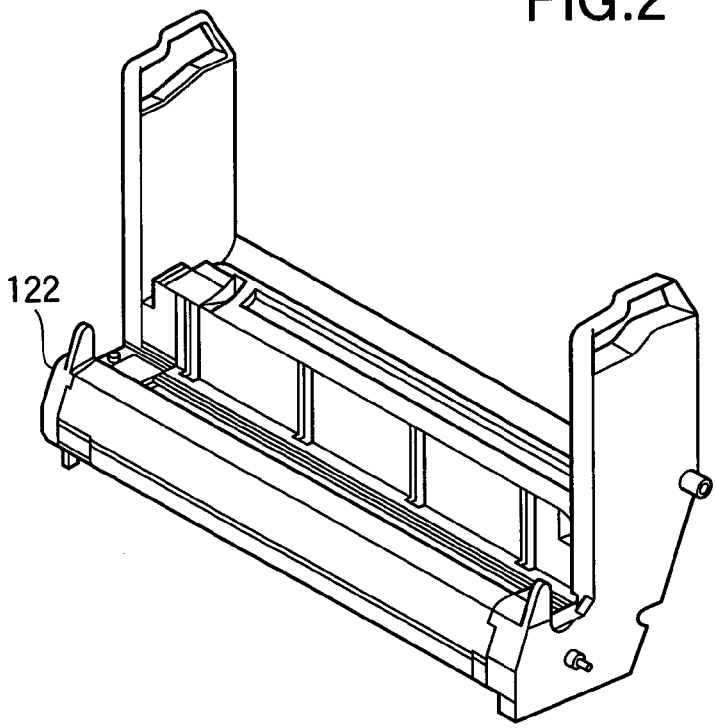
FIGS. 2 and 3 are perspective views of an image-forming unit according to the first embodiment.
Figure 3:
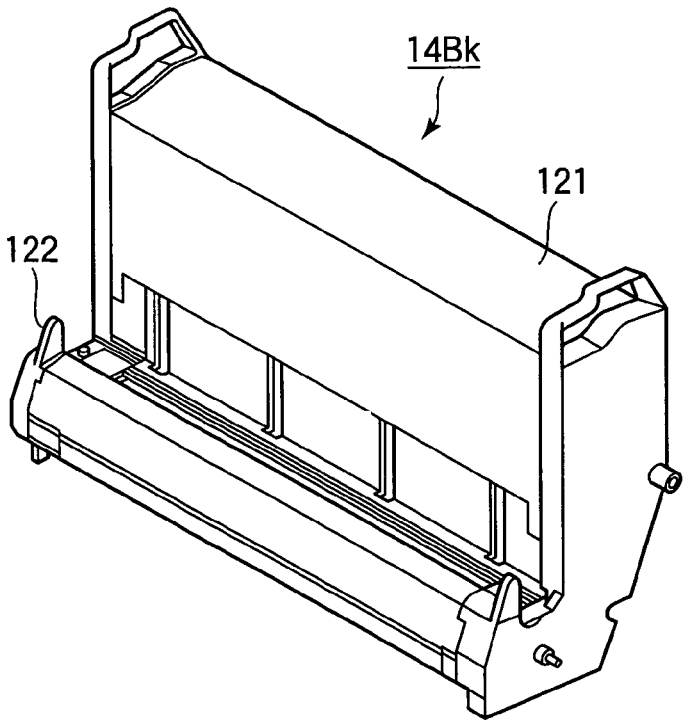

FIGS. 2 and 3 are perspective views of the image-forming unit 14BK according to the first embodiment.

Figure 4:
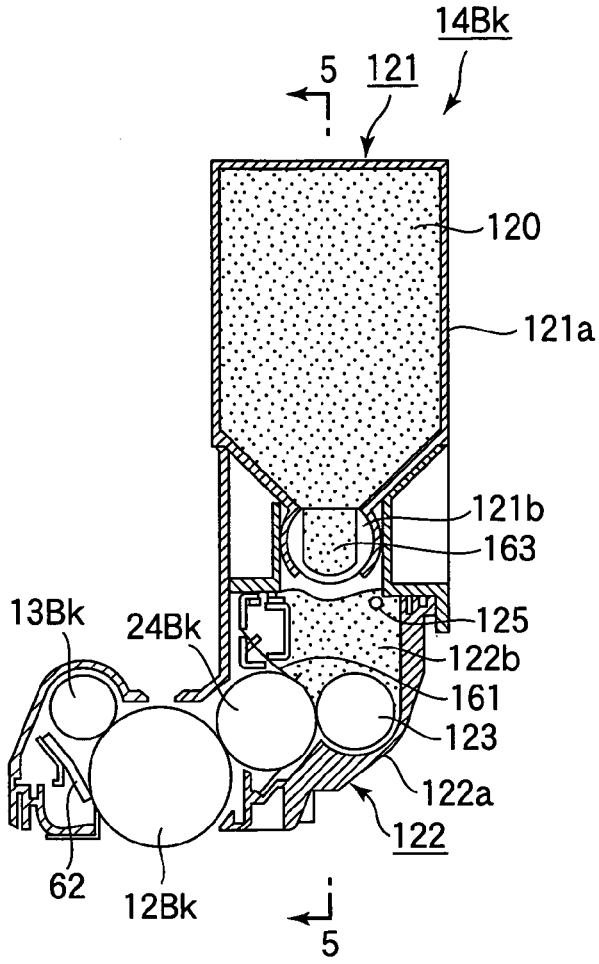
FIG. 4 is a cross-sectional side view of the image-forming unit of FIGS. 2 and 3.

FIG. 4 is a cross-sectional side view of the image-forming unit 14BK of FIGS. 2 and 3.

Referring to FIGS. 2–4, the image-forming unit 14BK includes a body 122 and a toner cartridge 121 detachably attached to the body 122. The toner cartridge 121 has a toner chamber 121*a* that holds toner 120 therein. The body 122 has a case 122*a* that accommodates the photoconductive drum 12BK, the developing roller 24BK, the toner supplying roller 123, a developing blade 161, and a cleaning member 162 therein. The case 122*a* also defines a toner reservoir 122*b* that holds the toner 120 supplied from the toner cartridge 121. The developing roller 24BK, toner-supplying roller 123, developing blade 161, and toner cartridge 121 form a developing unit.

The toner cartridge 121 includes a valve 121*b* that is rotatably received in a discharge opening of the toner chamber 121*a*. Each complete rotation of the valve 121*b* supplies a predetermined amount of the toner 120 from the toner chamber 121*a* into the toner reservoir 122*b*.

The supplying roller 123 supplies the toner 120 to the developing roller 24BK. The body 122 has a toner sensor 125 that detects a remaining amount of the toner 120. The toner detector 125 takes the form of, for example, a transmission type sensor that includes a light emitting element mounted on one end of the body 122 and a light receiving element mounted on the other end of the body 122.

Figure 5:
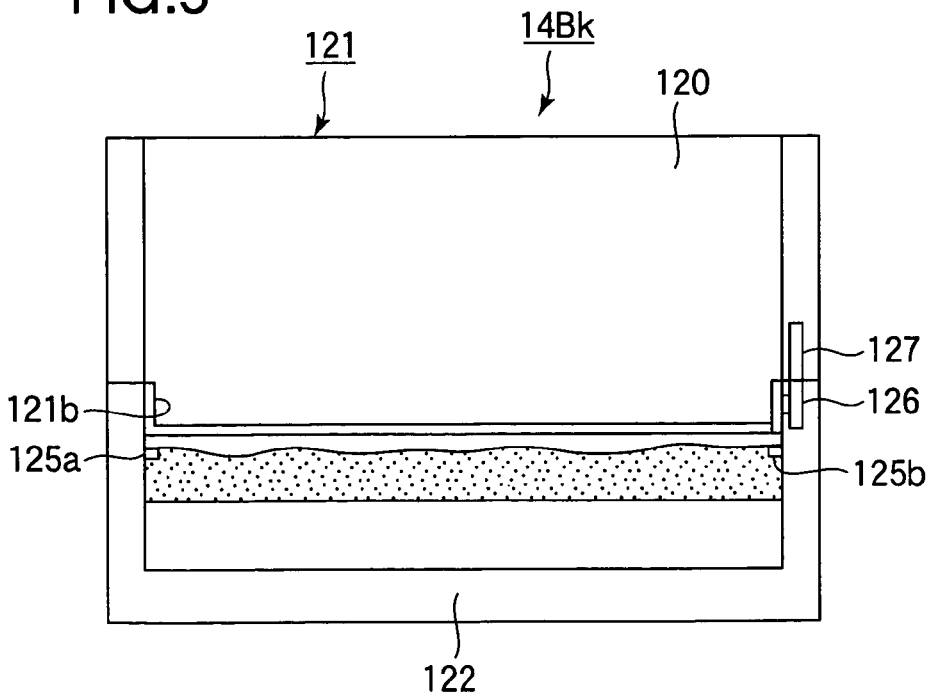
FIG. 5 is a cross-sectional side view of the image-forming unit of FIG. 4, taken along line 5—5 of FIG. 4.

FIG. 5 is a cross-sectional side view of the image-forming unit of FIG. 4, taken along line 5—5 of FIG. 4.

The toner sensor 125 includes a light emitting-element 125*a* and a light-receiving element 125*b*. For example, when the remaining amount of toner in the toner reservoir 122*b* increases, the pile of toner enters the light path between the light-emitting element 122*b* and the light-receiving element 122*b* of the transmission type sensor. Then, the toner sensor 125 generates a detection output indicating that the surface of the pile of toner is as high as the toner sensor 125. When the remaining amount of toner in the toner reservoir 122*b* decreases, the pile of toner moves out of the light path, the toner sensor 125 generates a detection output indicating that the surface of the pile of toner is not as high as the toner sensor 125. Based on the amount detected by the toner sensor 125, a controller 135 (FIG. 7) controls the amount of the toner 120 to be supplied from the toner cartridge 121 into the toner reservoir 122*b*.

Figure 6:
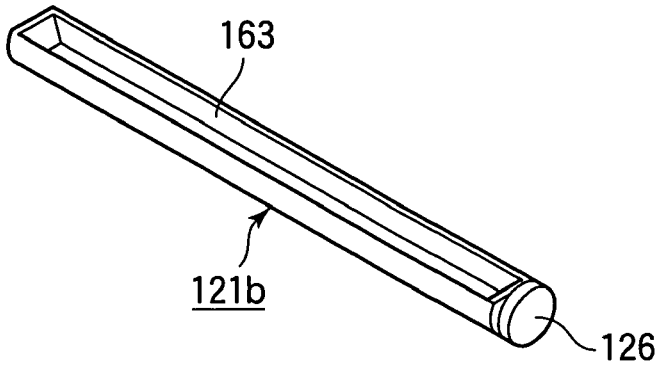
FIG. 6 is a perspective view of a valve of FIG. 4.

FIG. 6 is a perspective view of the valve 121*b* of FIG. 4. The valve 121*b* is formed with a groove 163 therein that extends in a longitudinal direction of the valve 121*b*. A gear 126 is mounted to one longitudinal end of the valve 121*b*. When a motor 127 drives the gear 126 in rotation, the gear 126 causes the valve 121*b* to rotate, so that every time the valve 121*b* makes one complete rotation, the toner 120 held in the groove 163 is discharged from the case 121*a* of the toner cartridge 121 into the toner reservoir 122*b*.

Figure 7:
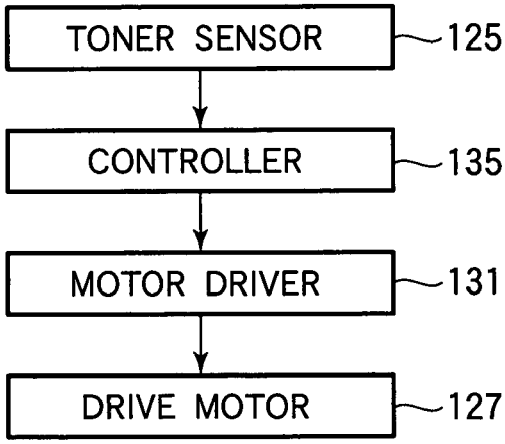
FIG. 7 is a block diagram illustrating an image-forming unit according to the first embodiment.

FIG. 7 is a block diagram illustrating an image-forming unit 14BK according to the first embodiment. The operation of the image-forming unit 14BK of the aforementioned configuration will be described.

Referring to FIG. 7, the toner sensor 125 detects a remaining amount of toner held in the toner reservoir 122*b* to generate a detection signal. The detection signal is sent to the controller 135. When the detection signal is OFF, i.e., the remaining amount of toner 120 is less than a threshold value, then the controller 135 drives a motor driver 131, thereby driving the motor 127 to supply the toner 120 into the toner reservoir 122*b*.

The toner sensor 125 is mounted in the body 122 at a height above which the remaining amount of toner fills more than a predetermined percentage, for example, 80% of the total inner volume of the toner reservoir 122*b* that can hold the toner 120.

Figure 8:
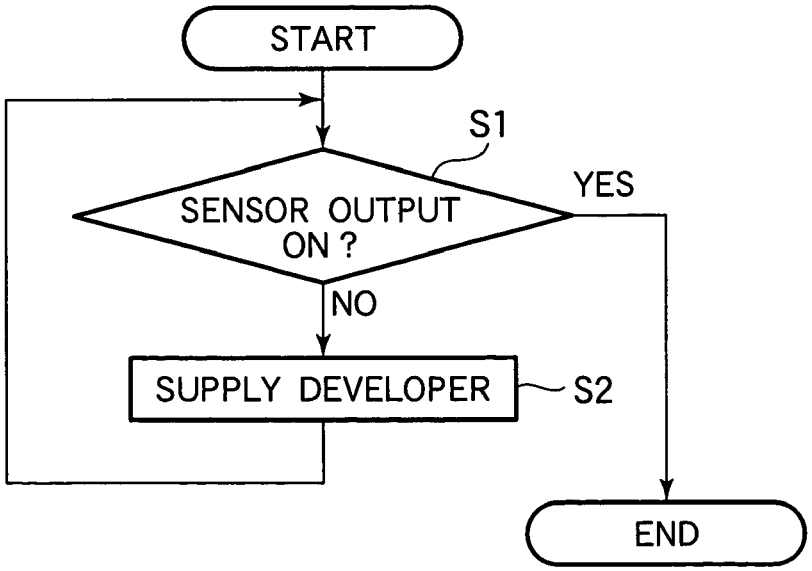
FIG. 8 is a flowchart illustrating the operation of the image-forming unit in FIG. 4 and FIG. 7.

FIG. 8 is a flowchart illustrating the operation of the image-forming unit 14BK in FIG. 4 and FIG. 7.

Step 1: A check is made to determine whether the detection signal of the toner sensor 125 is ON. If the detection signal is ON, the program ends. If the detection signal is OFF, the program proceeds to step S2.

Step S2: The toner 120 is supplied from the toner chamber 121*a* into the toner reservoir 122*b*.

Figure 9:
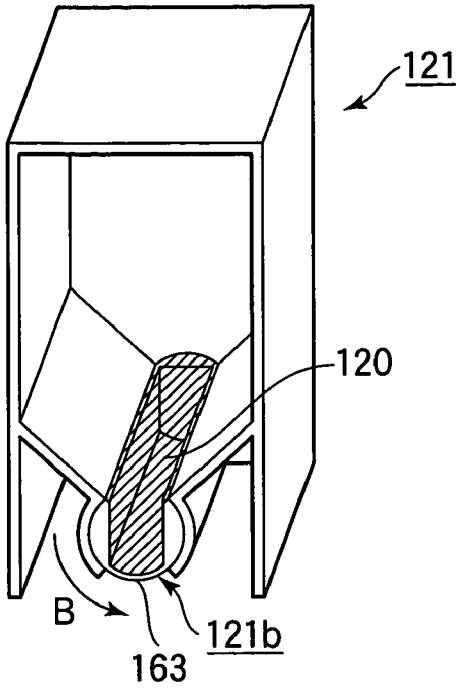
FIGS. 9 and 10 illustrate the positions of the valve.
Figure 10:
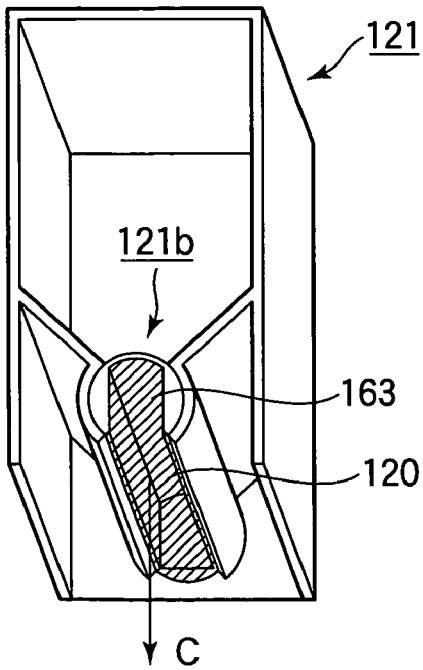

FIGS. 9 and 10 illustrate the positions of the valve 121*b*.

When the valve 121*b* is at a rotational position shown in FIG. 9, the groove 163 is upwardly open, so that the groove 163 is filled with the toner 120. When the motor 127 drives the valve 121*b* to rotate in a direction shown by arrow B, the valve 121*b* is rotated to a rotational position shown in FIG. 10 where the groove 163 is downwardly open, allowing the toner 120 to fall in a direction shown by arrow C into the toner reservoir 122*b*. The drive motor 127 continues to drive the valve 121*b* in rotation in the B direction as long as the detection signal of the toner sensor 125 remains OFF.

When the detection signal of the toner sensor 125 becomes ON, the controller 135 causes the drive motor 127 to stop, thereby stopping the rotation of the valve 121*b*.

When the top surface of the pile of toner 120 held in the body 122 reaches a height immediately below the valve 121*b*, the toner reservoir 122*b* is full of the toner 120.

The toner chamber 121*a* and the toner reservoir 122*b* are effectively isolated from each other by the valve 121*b*, and every time the valve 121*b* makes one complete rotation, a predetermined amount of the toner 120 is supplied from the toner chamber 121*a* into the toner reservoir 122*b*.

In the present embodiment, the remaining amount of the toner 120 held in the toner reservoir 122*b* is prevented from exceeding a predetermined volume, for example, 80% of the total inner volume of the toner reservoir 122*b*. Therefore, the toner 120 will not agglomerate in the toner reservoir 122*b* so that the deterioration of the toner 120 is minimized.

A description will now be given of print results when printing is performed for a variety of remaining amounts of toner in the toner reservoir 122*b*.

Figure 11:
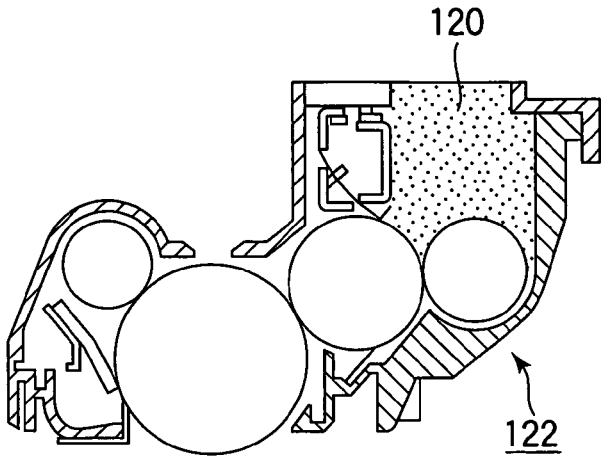
FIG. 11 illustrates a toner reservoir when it is full of toner.

FIG. 11 illustrates the toner reservoir 122*b* when it is full of the toner 120.

Figure 12:
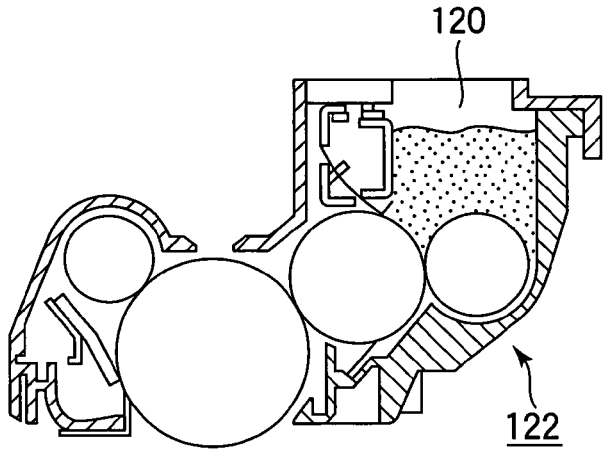
FIG. 12 illustrates the toner reservoir when the remaining toner fills about 80% of a total inner volume of the toner reservoir.

FIG. 12 illustrates the toner reservoir 122*b* when the remaining toner fills about 80% of a total inner volume of the toner reservoir 122*b*.

The print results are represented in terms of image quality after continuous printing of 1,000 pages under the conditions listed in Table 1. The degree of deterioration of the toner 120 can be known from the print results.

TABLE 1

| PRINT DENSITY | INNER VOLUME OCCUPIED BY TONER | | |
|---|---|---|---|
| (%) | 80% | 90% | 100% |
| 1 | ○ | Δ | X |
| 5 | ○ | ○ | X |
| 25 | ○ | ○ | Δ |
| 50 | ○ | ○ | ○ |
| 100 | ○ | ○ | ○ |

When the toner fills 100% of the total inner volume of the toner reservoir 122*b*, the remaining amount of toner 120 is level volume of the body 122, i.e., just leveled off by the valve 121*b* so that the toner 120 is not in a packed condition. Amounts of the toner 120 are measured such that the toner 120 held in the body 122 is not subjected to tapping but aerated.

Figure 13:
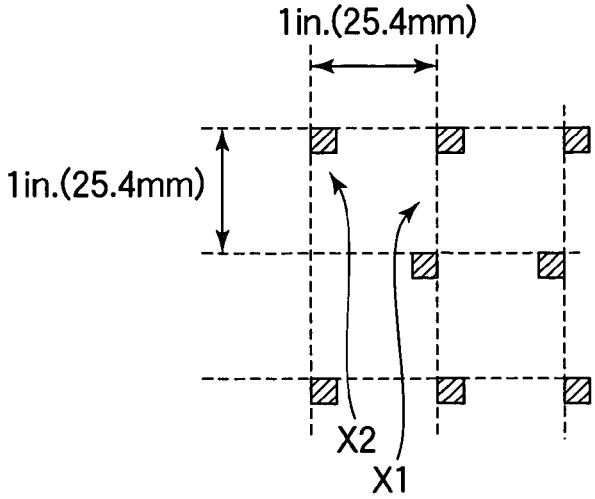
FIG. 13 illustrates the print density in the first embodiment.

FIG. 13 illustrates the print density in the first embodiment.

Referring to FIG. 13, print density ρ is the ratio of a printed area X2 to an area X1 of one-inch square on the print paper and is calculated as follows:

$$\rho=(X2/X1)\times 100\%$$

Referring to Table 1, symbol ○ denotes an excellent condition where deposition of toner to the background of the printed images is not detectable. Symbol Δ denotes an acceptable condition where little deposition of the toner to the background of the printed image is detectable. Symbol X denotes a poor condition where excess deposition of the toner to the background of the printed image is detected.

Second Embodiment

Elements similar to those in the first embodiment have been given like reference numerals and the description thereof is omitted.

Figure 14:
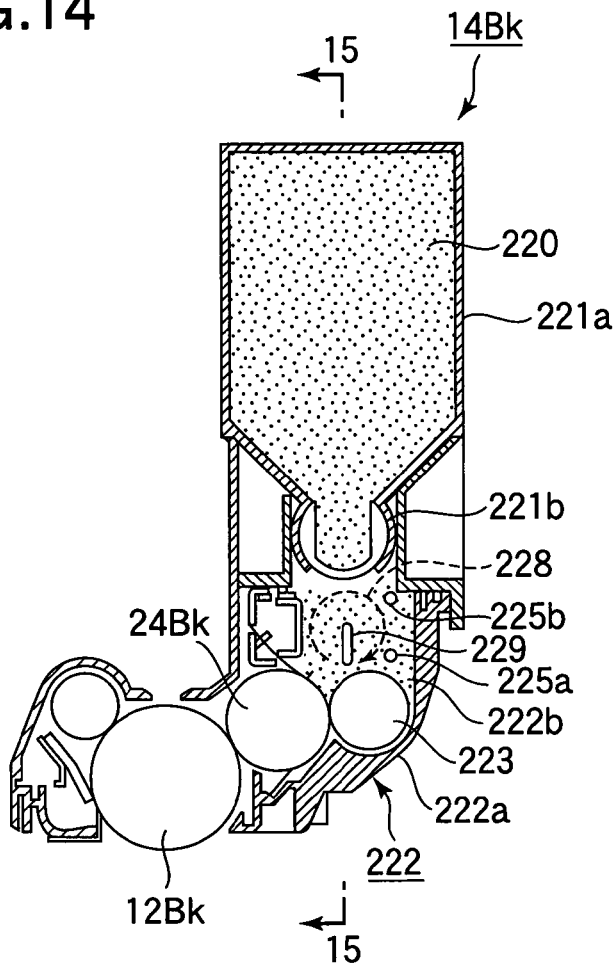
FIG. 14 is a cross-sectional view of a toner reservoir of an image-forming unit according to a second embodiment.

FIG. 14 is a cross-sectional view of an image-forming unit 14BK (FIG. 1) according to a second embodiment.

Figure 15:
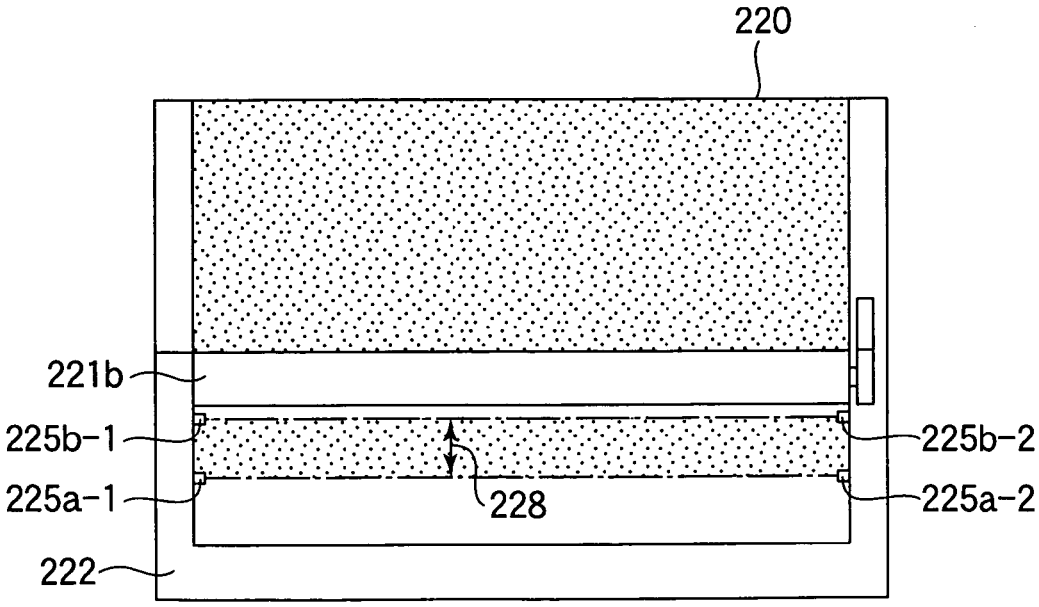
FIG. 15 is a cross-sectional view of the image-forming unit, taken along line 15—15 of FIG. 14.

FIG. 15 is a cross-sectional view of the image-forming unit of FIG. 14, taken along line 15—15.

Referring to FIG. 14, each complete rotation of the valve 221*b* supplies a predetermined amount of toner 220 from the toner chamber 221*a* into the toner reservoir 222*b*. The toner reservoir 222*b* has an agitator 229 therein that rotates to agitate the toner 220. The agitator 229 is similar to an agitator 527 in FIG. 31. The agitator 229 is located in the agitation region 228 and is rotatably supported. The agitator 229 extends in a longitudinal direction parallel to the rotational axes of a photoconductive drum 12BK (FIG. 1) a developing roller 24BK (FIG. 1), and a toner supplying roller 223.

There are provided a first sensor 225*a* and a second sensor 225*b* located adjacent the agitation region 228 where an agitator 229 agitates the toner 220. The first and second sensors 225*a* and 225*b* take the form of, for example, a transmission type photo-sensor that is the same as toner sensor 125 in the first embodiment. The first sensor 225*a* includes a light-emitting element 225*a*-1 and a light receiving-element 225*a*-2. The second sensor 225*b* includes a light emitting-element 225*b*-1 and a light-receiving element 225*b*-2. For example, when the remaining amount of toner in the toner reservoir 222*b* increases, the pile of toner enters the light path between the light-emitting element 225*b*-1 and the light-receiving element 225*b*-2 of the transmission type sensor. Then, the second sensors 225*b* generates a detection output indicating that the surface of the pile of toner is as high as the second sensor 225*b*. When the remaining amount of toner in the toner reservoir 222*b* decreases, the pile of toner moves out of the light path, the second sensor 225*b* generates a detection output indicating that the surface of the pile of toner is not as high as the second sensor 225*b*. The first sensor 225*a* operates in much the same way as the second sensor 225*b*. The second sensor 225*b* is located somewhere between the top dead center (TDC) of the agitator 229 and the rotational axis of the agitator 229. The first sensor 225*a* is disposed somewhere between the bottom dead center (BDC) of the agitator 229 and the rotational axis of the agitator 229.

Figure 16:
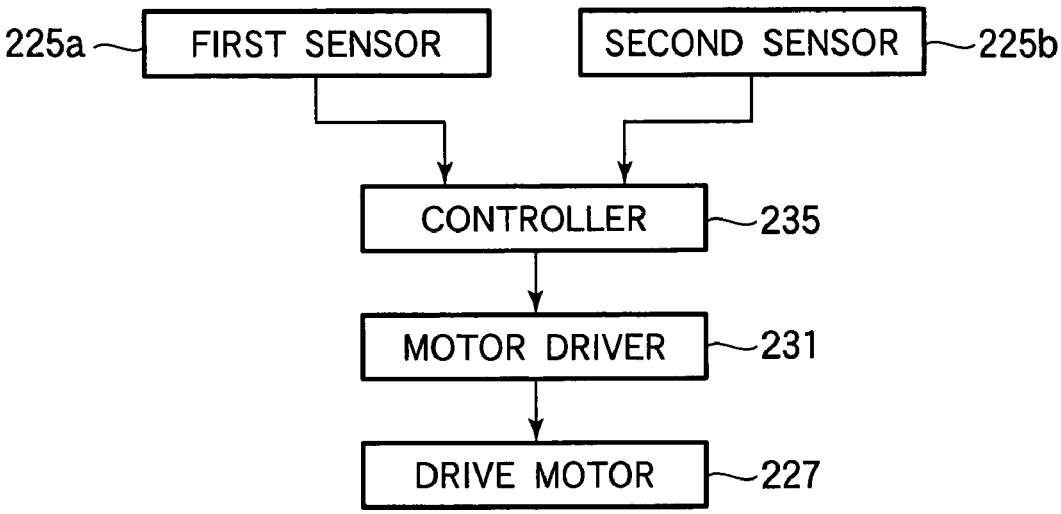
FIG. 16 is a block diagram of the image-forming unit according to the second embodiment.

FIG. 16 is a block diagram of the image-forming unit 14BK according to the second embodiment.

Figure 17:
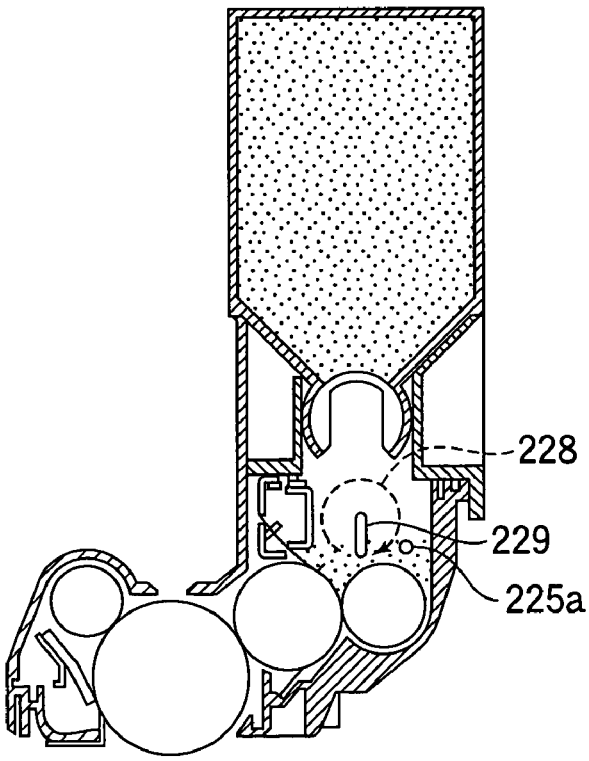
FIG. 17 illustrates the remaining amount of toner when the top surface of the pile of toner is at a first sensor.

FIG. 17 illustrates the remaining amount of toner when the top surface of the pile of toner is at the first sensor 225*a*.

Figure 18:
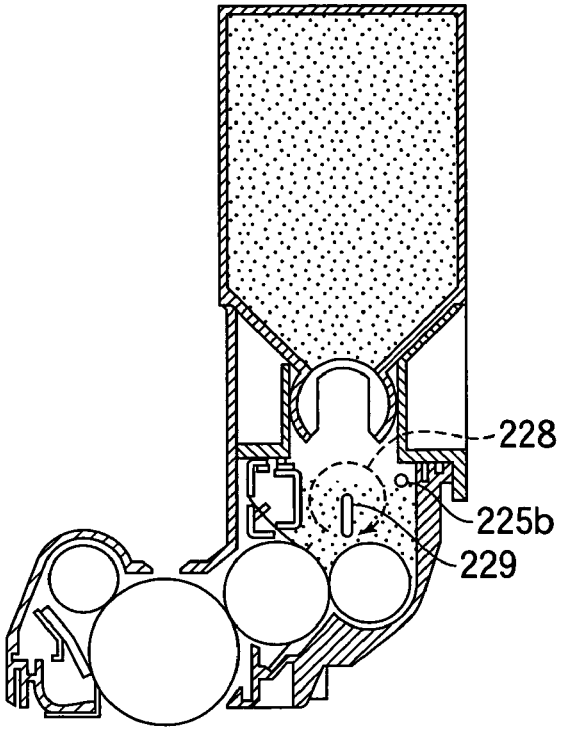
FIG. 18 illustrates the remaining amount of toner when the top surface of the pile of toner is at a second sensor.

FIG. 18 illustrates the remaining amount of toner when the top surface of the pile of toner is at the second sensor 225*b*.

Referring to FIG. 16, when the first and second sensors 225*a* and 225*b* detect the toner 220, the detection signals are sent to the controller 235. If the first sensor 225*a* is OFF so that the remaining amount of toner 220 is below a threshold (minimum allowable level), the controller 235 drives the motor driver 231, thereby driving the drive motor 227 in rotation to supply the toner 220 into the toner reservoir 222*b*.

When the detection signal of the second sensor 225*b* becomes ON, the remaining amount of toner 220 has reached a maximum allowable level in the toner reservoir 222*b*. Thus, the controller 235 causes the drive motor 227 to stop, so that a valve 221*b* (FIG. 14) stops rotating.

In this manner, the top surface of the pile of remaining toner 220 is maintained between the first sensor 225*a* and the second sensor 225*b*, and therefore will not be higher than the agitation region 228 (circle denoted in dotted-lines) at any time.

Because the top surface of the pile of the remaining toner 220 will not be higher than the agitation region 228, when the agitator 229 agitates the toner 220, the toner 220 is well aerated so that the remaining toner 220 is maintained at an appropriate condition and prevented from deteriorating. This configuration not only prevents the charging characteristic of the toner 220 from deteriorating but also improves the charging characteristic of the toner 220, so that the toner 220 will not cling to the background of the printed image during printing, thereby improving print quality.

Because the toner reservoir 222*b* holds a just enough amount of toner 220 at all times, the excess density and blurring of images are prevented, thereby improving print quality.

A description will now be given of print results when printing is performed for a variety of heights of the pile of toner in an agitation region 228 in the toner reservoir 222*b* occupied by the remaining amounts of toner.

TABLE 2

| PRINT DENSITY | AGITATION REGION OCCUPIED BY TONER | | |
|---|---|---|---|
| (%) | 10% | 20% | 30% |
| 1 | ○ | ○ | ○ |
| 5 | Δ | ○ | ○ |
| 25 | X | Δ | ○ |

TABLE 2-continued

| PRINT DENSITY | AGITATION REGION OCCUPIED BY TONER | | |
|---|---|---|---|
| (%) | 10% | 20% | 30% |
| 50 | X | Δ | ○ |
| 100 | X | Δ | ○ |

Referring to Table 2, symbol ○ denotes an excellent condition where deposition of toner to the background of the printed image is not detectable. Symbol Δ denotes an acceptable condition where little deposition of the toner to the background of the printed image is detectable. Symbol X denotes a poor condition where an excess amount of toner is deposited to the background of the printed image.

The results in Table 2 reveal that when the toner fills 30% of the agitation region 328 in the toner reservoir 222*b*, the image quality can be improved.

Figure 19:
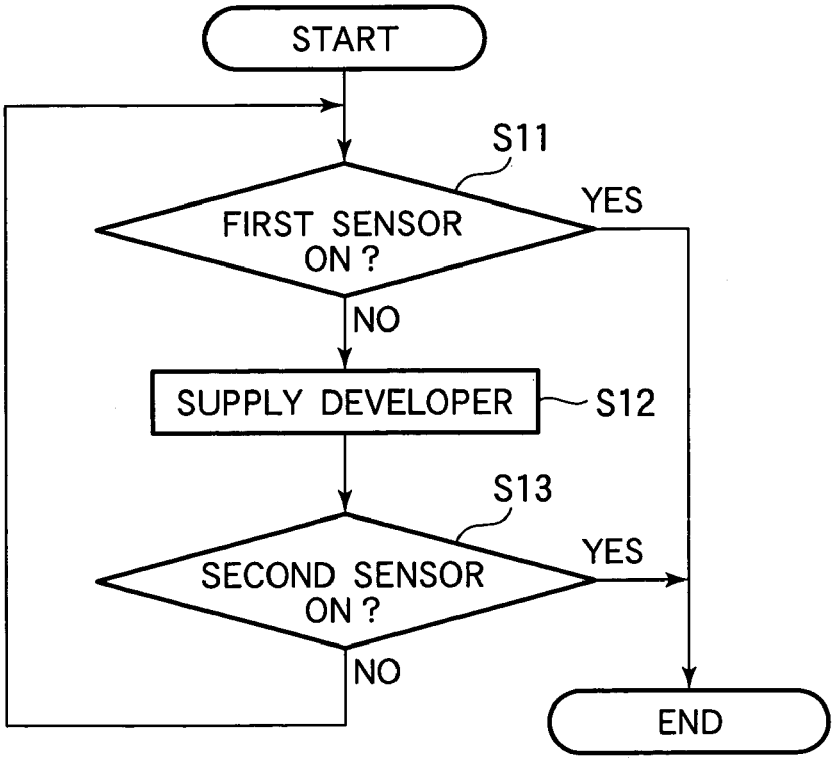
FIG. 19 is a flowchart illustrating the operation of the image-forming unit according to the second embodiment.

FIG. 19 is a flowchart illustrating the operation of the image-forming unit according to the second embodiment.

Step S11: A check is made to determine whether the detection signal of the first sensor 225*a* is ON. If the detection signal of the first sensor 225*a* is ON, then the program ends. If the detection signal of the first sensor 225*a* is OFF, then the program proceeds to step S12.

Step S12: The toner 220 is supplied from the toner chamber 221*a* into the toner reservoir 222*b*.

Step S13: A check is made to determine whether the detection signal of the second sensor 225*b* is ON. If the detection signal of the sensor 225*b* is ON, then the program ends. If the detection signal of the second sensor 225*b* is OFF, then the program jumps back to step S11.

Third Embodiment

Figure 20:
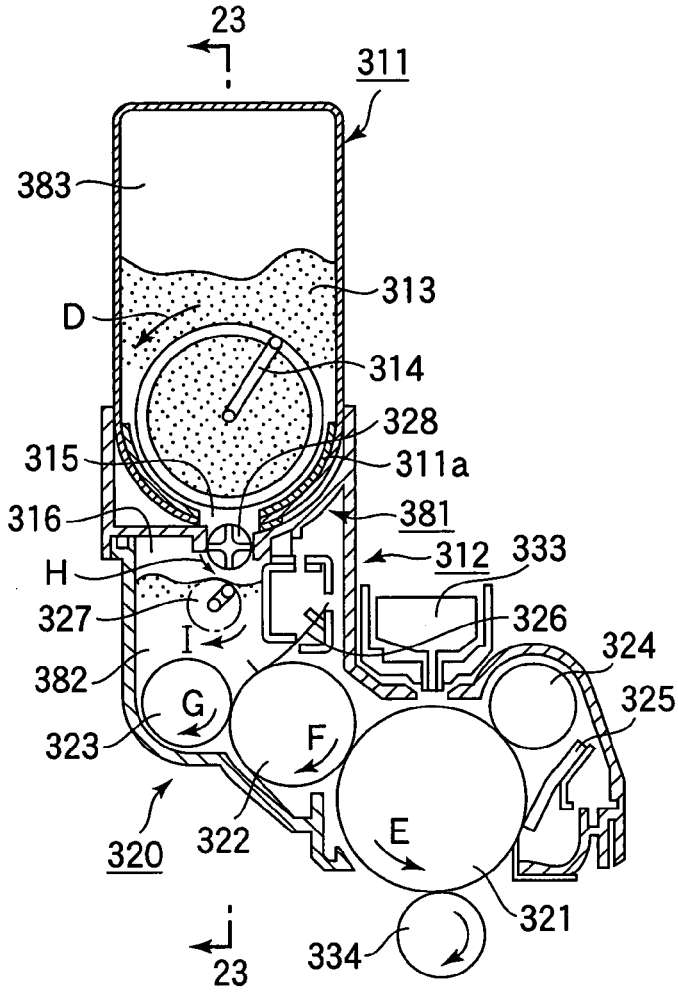
FIG. 20 is a cross-sectional view of an ID unit (Image Drum Unit) according to a third embodiment when printing is performed at a low print duty.

FIG. 20 is a cross-sectional view of an ID unit (Image Drum Unit) 320 when printing is performed at a low print duty.

Referring to FIG. 20, a process cartridge 312 has a toner reservoir 382. A toner cartridge 311 has a toner chamber 383 and is detachably mounted to the process cartridge 312. The toner cartridge 311 and the process cartridge 312 form the ID unit 320. The toner cartridge 311 holds toner 313 therein. A transport spiral 314 is rotatably supported in the toner cartridge 311 and is of the same configuration as a transport spiral 514 in FIG. 31. The transport spiral 314 rotates in a direction shown by arrow D to transport the toner 313 toward the middle of the toner cartridge 311. The toner 313 is transported into the process cartridge 312 through a toner outlet 315 formed in the middle of the toner cartridge 311. A shutter 311*a* is disposed at the bottom of the toner cartridge 311. The shutter 311*a* remains closed until the toner cartridge 311 has been attached to the process cartridge 312.

The process cartridge 312 include a photoconductive drum 321, a charging roller 324, a developing roller 322, a toner supplying roller 323, and a cleaning device 25. The photoconductive drum 321 rotates in a direction shown by arrow E. The developing roller 322 rotates in a direction shown by arrow F. The toner supplying roller 323 rotates in a direction shown by arrow G. There are also provided an exposing unit 333 that opposes the circumferential surface of the photoconductive drum 321. A transfer roller 334 transfers a toner image from the photoconductive drum 321 onto a print paper.

Figure 21:
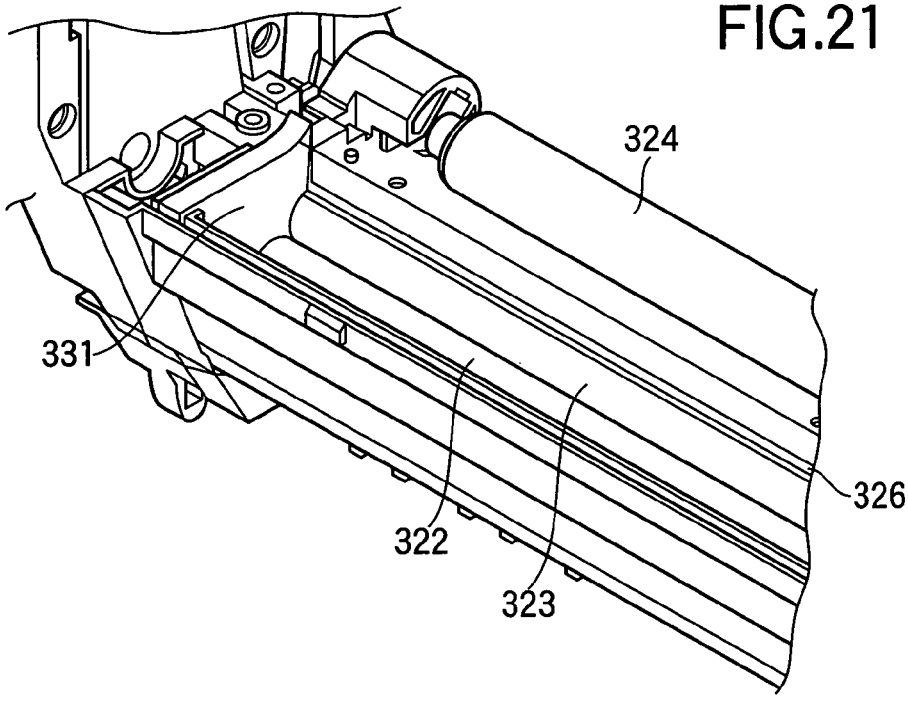
FIG. 21 is a perspective view of a sealing portion that prevents leakage of toner.

FIG. 21 is a perspective view of a sealing portion that prevents leakage of toner.

The developing roller 322 and toner supplying roller 323 have a toner sealing members 331 at their longitudinal ends. The toner sealing members 331 prevent the toner 313 in the toner reservoir 382 from leaking.

Referring back to FIG. 20, with the printer of the aforementioned configuration, the charging roller 324 charges the entire surface of the photoconductive drum 321 uniformly to a predetermined potential. The exposing unit 333 illuminates the charged surface of the photoconductive drum 321 to form an electrostatic latent image. The developing roller 322 develops the electrostatic latent image with the toner 313 to form a toner image. The transfer roller 334 transfers the toner image onto a print medium, not shown. The toner 313 is supplied from the toner cartridge 311 into the process cartridge 312, then supplied by the toner supplying roller 323 to the developing roller 322. A developing blade 326 forms a thin layer of the toner 313 on the developing roller 322.

The print medium is then transported to a fixing unit, not shown, and the toner image on the print medium is fused. Some of the toner 313 remains on the photoconductive drum 321 after transfer of the toner image onto the print medium. The cleaning device 325 removes residual toner from the photoconductive drum 321.

Figure 22:
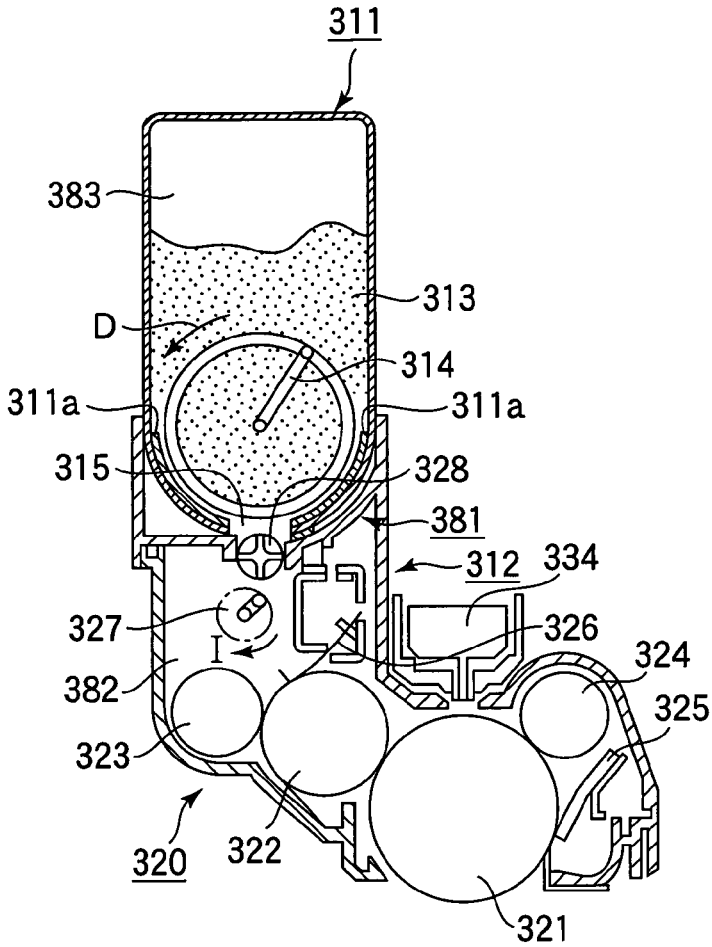
FIG. 22 is a cross sectional view of the ID unit according to the third embodiment when printing is performed at a high printing duty.

The process cartridge 312 has a receiving section 381 that receives the toner cartridge 311 therein. The receiving section 381 includes a rotary valve 328 rotatably mounted in a bottom wall of the toner cartridge 311. The valve 328 extends in parallel to the rotational axes of the developing roller 322 and toner supplying roller 323. The valve 328 is mounted on a middle portion of a shaft 352*a* (FIG. 23) rotatably supported by the receiving section 381 (FIG. 22). The motor 337 drives a gear 330 mounted to one end of the shaft 352*a* in rotation so that the rotation of the gear 330 causes the valve 328 to control the amount of the toner 313 supplied from the toner cartridge 311 to the process cartridge 312.

The replenishment amount of T of the toner 313 from the toner chamber 383 into the process cartridge 312 is controlled in such a way that the remaining amount of toner is between a lower limit and an upper limit. The replenishment amount T of the toner 313 per second is given by $2W \leqq T \leqq 10W$, assuming that W (g/sec) is the amount of toner consumed per second when printing is being performed at a printing duty of 100%. For example, W is about 0.4 g/sec when printing at a print duty of 100% is performed on A4-size paper at a speed of 40 pages per minute. The replenishment amount of T is set to a predetermined fixed value between 2W and 10W depending on the design specification and parameters of the apparatus.

FIG. 22 is a cross sectional view of the ID unit 320 when printing is performed at a high printing duty.

Figure 23:
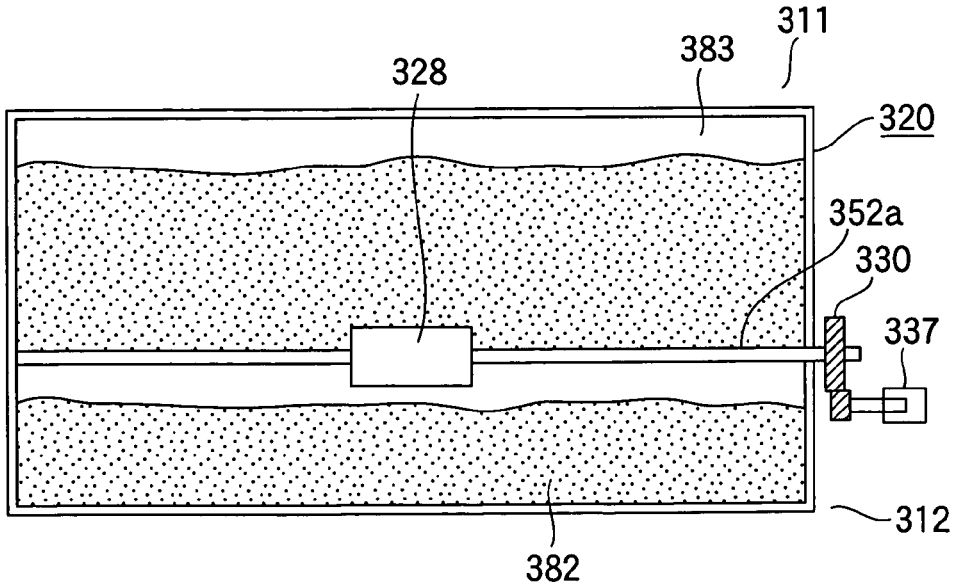
FIG. 23 is a cross-sectional front view of the ID unit, taken along lines 5—5 of FIG. 20.

FIG. 23 is a cross-sectional front view of the ID unit 320, taken along lines 23—23 of FIG. 20.

For printing at a high printing duty, a large amount of toner 313 is consumed. Therefore, as shown in FIG. 20, a volume 316 of air is created in the process cartridge 312 immediately under the valve 328. The toner 313 held in the process cartridge 312 is agitated by an agitator 327 rotating in a direction shown by arrow I, being prevented from agglomerating and deteriorating. The agitator 327 is of a similar configuration to an agitator 527 in FIG. 31.

Once the valve 328 is driven in rotation, the valve 28 continues to be rotated so that the toner 313 in an amount of more than 2W is supplied into the toner reservoir 382. This will prevent blurred printed images which would otherwise occur due to insufficient supply of toner.

Referring back to FIG. 20, printing at a low print duty consumes a relatively small amount of toner in contrast to printing at a high print duty, so that the volume 316 of air may not be created. In the present invention, the valve 328 is driven in rotation in such a way that the replenishment amount of the toner 313 is not more than 10W. Therefore, the toner 313 more than necessary is not supplied into the process cartridge 12. The agitator 327 agitates the toner 313 held in the process cartridge 312, so that the toner 313 is aerated.

Because the replenishment amount T of the toner 313 into the process cartridge 312 is controlled in such a way that the remaining amount T of toner is maintained within a predetermined range, agglomeration and deterioration of the toner 313 can be prevented both in the high duty printing and in the low duty printing and blurring of printed images is prevented. Thus, print quality may be improved.

The present embodiment prevents the density of toner held in the process cartridge 312 from increasing, thereby limiting the pressure exerted on the sealing member 331 to improve the sealing effect of the sealing member 331.

Table 3 illustrates evaluation results of the sealing effect of the sealing member 331 for various print duties and replenishment amounts T of toner 313 into the process cartridge 312.

TABLE 3

| PRINT DENSITY | REPLENISHMENT AMOUNT "T" OF TONER | | | | |
|---|---|---|---|---|---|
| (%) | W | 2 W | 10 W | 20 W | 50 W |
| 1 | ○ | ○ | ○ | X | X |
| 5 | Δ | ○ | ○ | X | X |
| 50 | X | ○ | ○ | Δ | X |
| 100 | X | ○ | ○ | ○ | Δ |

Referring to Table 3, symbol ○ denotes an excellent condition where deposition of toner to the background of the printed image is not detectable. Symbol Δ denotes an acceptable condition where little deposition of the toner to the background of the printed image is detectable. Symbol X denotes a poor condition where an excess amount of the toner is deposited to the background of the printed image. Symbol Δ indicates that blurring is less than 5% while symbol X indicates that blurring is more than 5%.

Table 4 illustrates sealing effect for various replenishment amount "T" of toner.

TABLE 4

| REPLENISHMENT AMOUNT "T" OF TONER | | | | |
|---|---|---|---|---|
| W | 2 W | 10 W | 20 W | 50 W |
| ○ | ○ | ○ | Δ | X |

For sealing effect, referring to Table 4, symbol ○ indicates that the toner does not deposit on the print medium and there is no problem in normal printing of characters. Symbol Δ indicates that there is some amount of leakage of toner outside of a region in which the print medium is transported. Symbol X indicates that there is a significant leakage within a region in which the print medium is transported.

Fourth Embodiment

Elements similar to those in the third embodiment have been given like reference numerals and the description thereof is omitted.

Figure 24:
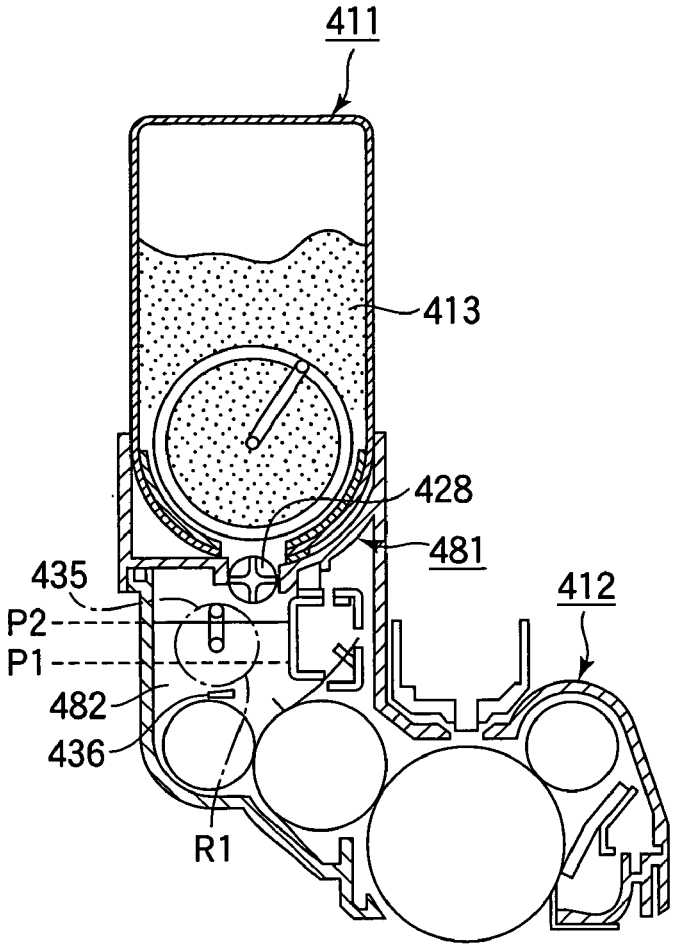
FIG. 24 is a cross-sectional view of an ID unit according to a fourth embodiment.

FIG. 24 is a cross-sectional view of an ID unit according to a fourth embodiment.

Figure 25:
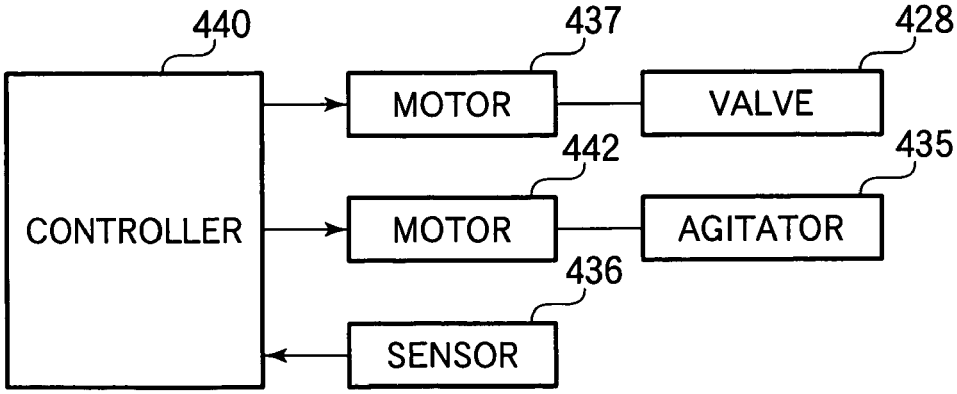
FIG. 25 is a block diagram illustrating a controller for a printer according to the fourth embodiment.

FIG. 25 is a block diagram illustrating a control block of a printer according to the fourth embodiment.

Figure 31:
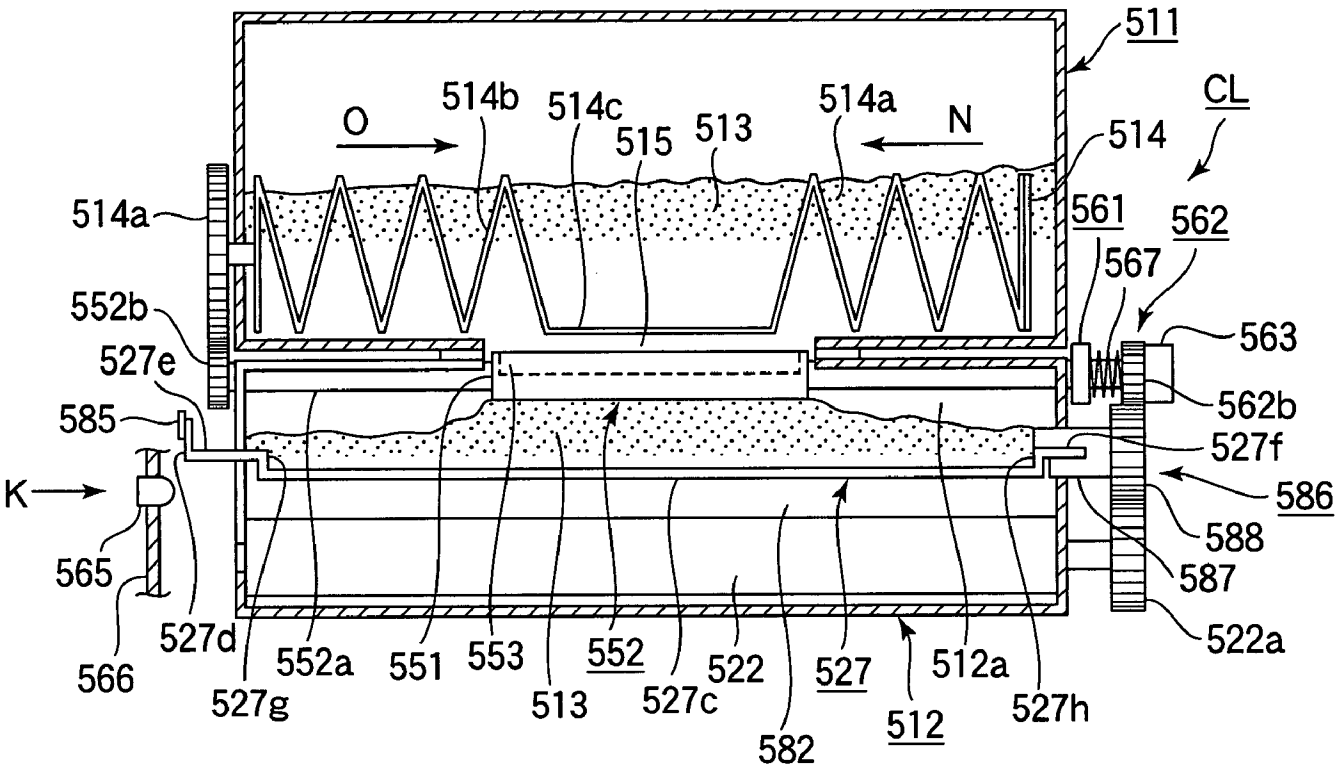
FIG. 31 is a longitudinal cross-sectional view of the ID unit, taken along lines 29—29 of FIG. 30.

Referring to FIG. 24, an agitator 435 is of the same configuration as an agitator 527 in FIG. 31 and is driven in rotation by the same mechanism (FIGS. 31, 33, and 34) as an agitator 527. The agitator 435 agitates toner 413 held in a process cartridge 412 while at the same time co-operating with a sensor 436 to function as a remaining toner detecting member. The agitator 435 is driven in rotation by a motor 442 (FIG. 25) and detects the toner 413 remaining in a cylindrical agitation region R1 described by the rotation of the agitator 435. When the agitator 435 rotates past its top dead center (TDC), the agitator 435 drops to rotate freely by its weight and then lands on the toner 413. Then, the agitator 435 rotates toward its bottom dead center (BDC). The time required for the agitator 435 to reach the bottom dead center after passing the top dead center varies depending on the remaining amount of toner 435 held in the process cartridge 412.

Figure 26:
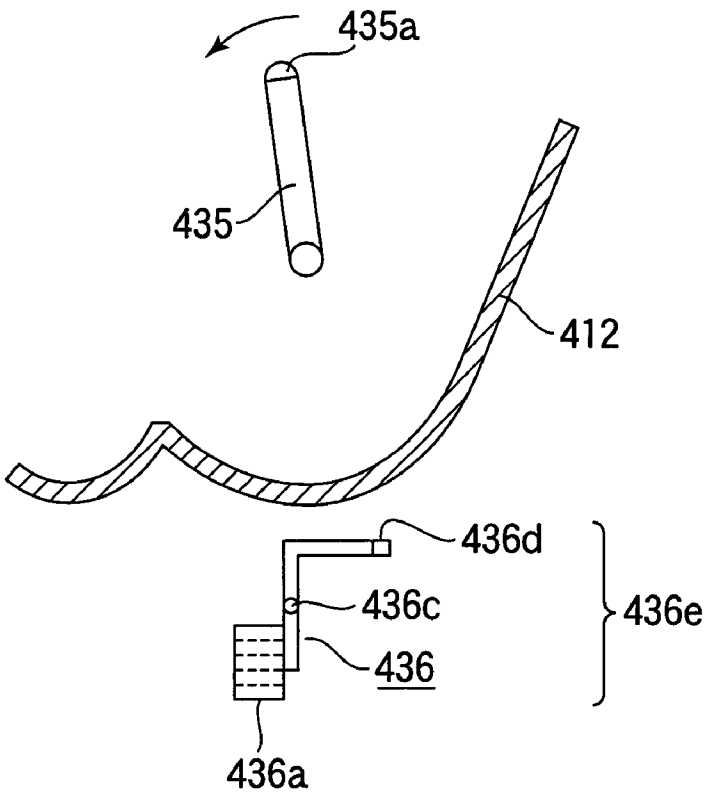
FIG. 26 illustrates a remaining toner detecting member when an agitator is at its to top dead center.

FIG. 26 illustrates a remaining toner detecting member when an agitator 435 is at its top dead center.

Figure 27:
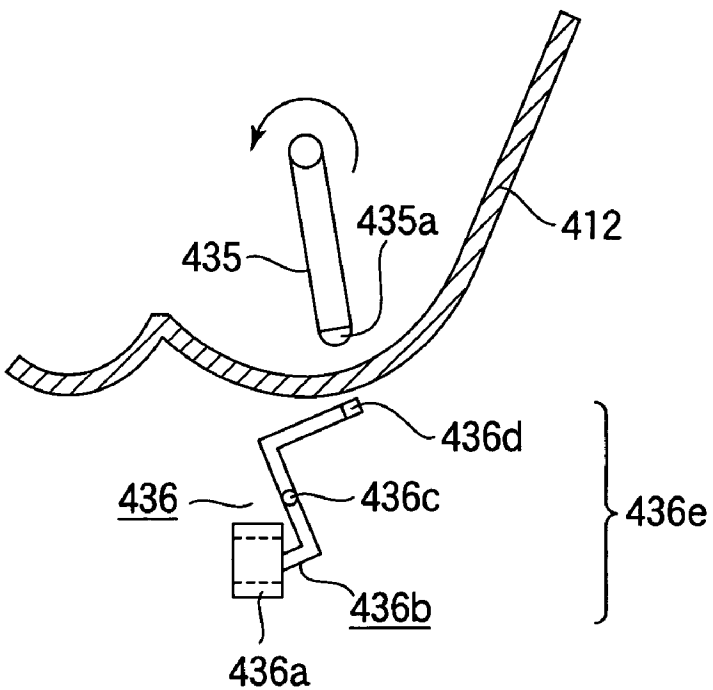
FIG. 27 illustrates the remaining toner detecting member when the agitator is at its bottom dead center.

FIG. 27 illustrates the remaining toner detecting member when the agitator 435 is at its bottom dead center.

Referring to FIGS. 26 and 27, the sensor 436 is disposed outside of the process cartridge 412 at a height immediately below the bottom dead center of the agitator 435. The crank of the agitator 435 has a small magnet 435*a* attached thereto. The sensor 436 is a combination of a transmission type sensor 436*a* and a pivoting lever 436*e* having a magnetic material 436*d* at its one end and a light blocking member 436*b* at its another end. As shown in FIG. 26, when the agitator 435 rotates away from the magnetic material 436*d*, the magnet does not attract the magnetic material 436*d* not to cause the pivoting lever 436*e* to pivot about a support pin 436*c*. Therefore, the light blocking member 436*b* moves into the transmission type sensor 436*a* to block the light path in the sensor 436*a*. As shown in FIG. 27, when the agitator 435 rotates to pass the magnetic material 436*d*, the magnet 435*a* attracts the magnetic material 436*d* to cause the pivoting lever 436*e* to pivot about the support pin 436*c*. Therefore, the light blocking member 436*b* moves out of the transmission type sensor 436*a* to leave the light path in the sensor 436*a*. In this manner, the sensor 436 detects the magnet mounted on the crank of the agitator 435 and outputs a detection signal. The detection signal of the sensor 436 is sent to a controller 440 (FIG. 25). The detection signal of the sensor 436 remains ON as long as the agitator 435 is at or near the bottom dead center. When the detection signal is ON, it is a high level. When the detection signal is OFF, it is a low level. The agitator 435 and sensor 436 form a remaining toner detector.

Figure 28:
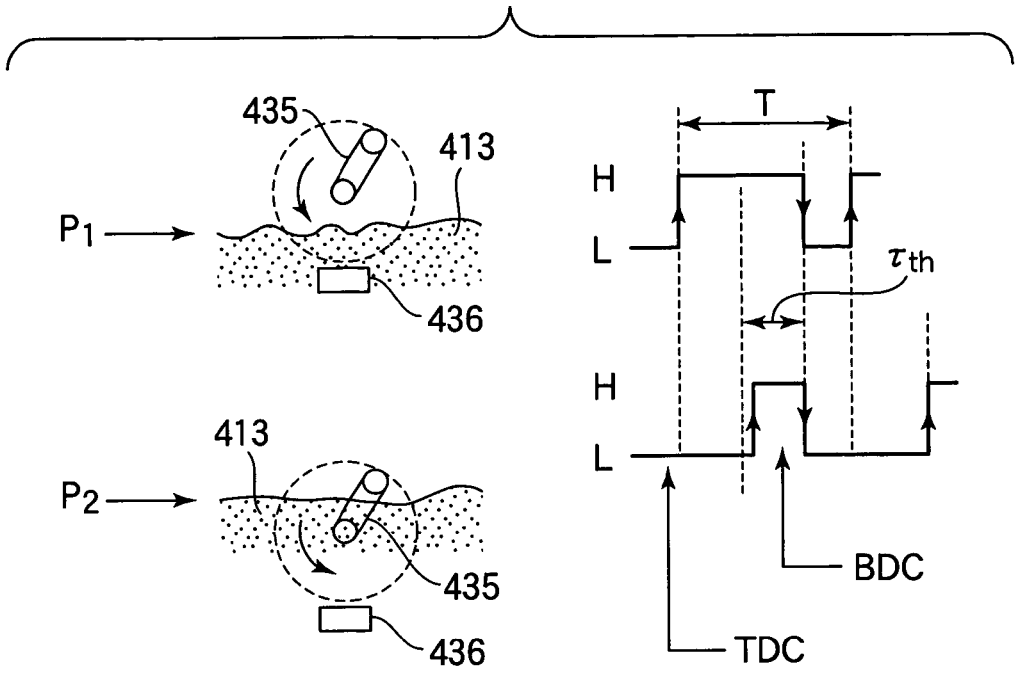
FIG. 28 illustrates the remaining toner detector according to the fourth embodiment and its detection signal when the remaining amount of toner is large.

FIG. 28 illustrates the remaining toner detector and its detection signal when the remaining amount of toner is large.

When the agitator 435 makes one complete rotation, the controller 440 calculates a time length during which the detection signal is a high level. If the time length is longer than a threshold τ th, it is determined that the remaining amount of toner held in the process cartridge 412 is small. T is the time required for the agitator 435 to make one complete rotation.

As shown in FIG. 28, the threshold τ th should preferably be a time length when the top surface of the toner 413 held in the process cartridge 412 is at a height near the center of rotation of the agitator 435.

Experiment reveals that when the agitator 435 rotates at a speed less than 30 rpm, a "toner-low" condition can be reliably detected.

When the controller 440 detects the toner-low condition, the controller 440 causes the motor 437 (FIG. 25) to drive the valve 428 in rotation.

Then, as the valve 428 rotates, the toner 413 is supplied from the toner cartridge 411 into the process cartridge 412. Thus, the replenishment amount T of the toner 413 at one continuous operation of the valve will be such that T≦10W. In this case, the replenishment amount T is controlled in terms of the time length during which the motor 437 rotates, i.e., the time length during which the valve 428 is rotated. After a predetermined time length has elapsed, the motor 437 is stopped.

Referring back to FIG. 24, the amount of the toner 413 held in the process cartridge 412 is always between position P1 and position P2. The position P1 is a height of the top surface of pile of toner at which a toner-low condition is detected by the sensor 436. The position P2 is a maximum allowable height of the top surface of pile of toner when a replenishment amount T of toner is supplied starting from the position P1. P2 is determined experimentally.

As described above, a sufficient amount of the toner 413 for image formation can be replenished and no blurring is caused. When the remaining amount of the toner 413 held in the process cartridge 412 increases as a result of replenishment of toner from the toner cartridge 411, the agitator 435 agitates the toner 413 so that the toner 413 will not agglomerate and deteriorate. This configuration prevents leakage of toner 413 which would otherwise occur due to excess pressure exerted on the toner 413.

Table 5 lists evaluation results of the sealing effect of the sealing member 431 for various print duties and replenishment amounts T of supplied toner, the toner level being between point P1 and point P2.

TABLE 5

| PRINT DENSITY | REPLENISHMENT AMOUNT "T" OF TONER | | | | |
|---|---|---|---|---|---|
| (%) | W | 2 W | 10 W | 20 W | 50 W |
| 1 | ○ | ○ | ○ | X | X |
| 5 | ○ | ○ | ○ | Δ | X |
| 50 | ○ | ○ | ○ | ○ | Δ |
| 100 | ○ | ○ | ○ | ○ | ○ |

Referring to Table 5, symbol ○ denotes an excellent condition where no soiling appears on the background of the printed images. Symbol Δ denotes an acceptable condition where some areas in a print image are high in density and some areas are low in density but there is no problem as long as characters are printed. Symbol X denotes a poor condition where blurring of printed images is more than 5%.

Table 6 illustrates sealing effect for various replenishment amounts "T" of toner.

TABLE 6

| REPLENISHMENT AMOUNT "T" OF TONER | | | | |
|---|---|---|---|---|
| W | 2 W | 10 W | 20 W | 50 W |
| ○ | ○ | ○ | Δ | X |

Referring to Table 6, symbol ○ indicates that no leakage of the toner 413 occurs. Symbol Δ indicates that little toner leakage occurs outside of a region through which the print medium passes, but there is no problem as long as characters are printed. Symbol X indicates that there is a significant leakage of toner within a region through which the print medium passes.

Figure 29:
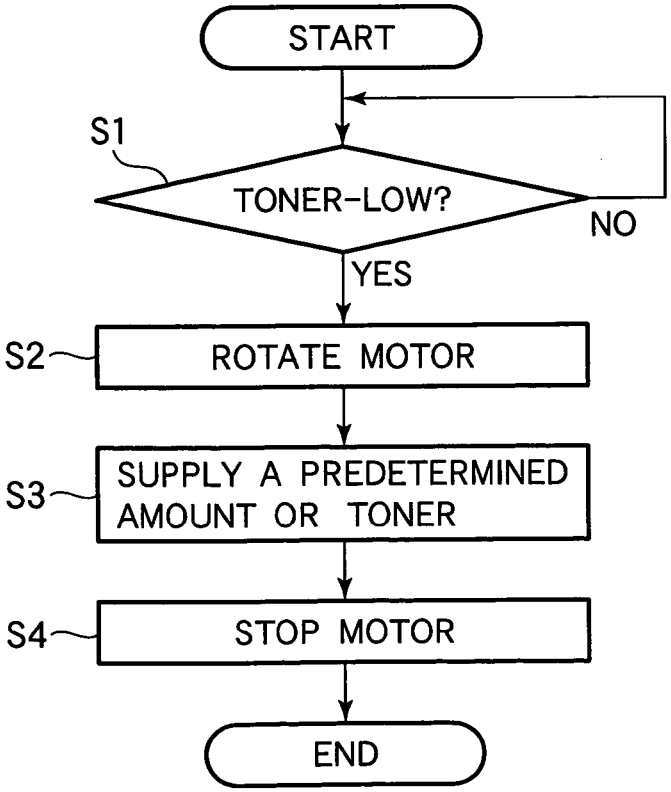
FIG. 29 is a flowchart illustrating the operation of the printer according to the fourth embodiment.

FIG. 29 is a flowchart illustrating the operation of the printer.

Step 1: If a toner-low condition is detected, the program proceeds to step S2.

Step S2: The motor 437 is driven in rotation.

Step S3: A predetermined amount of toner is supplied into the process cartridge.

Step S4: The motor 37 is stopped and the program ends.

Fifth Embodiment

Elements similar to those in the third and fourth embodiments have been given like reference numerals and the description thereof is omitted.

Figure 30:
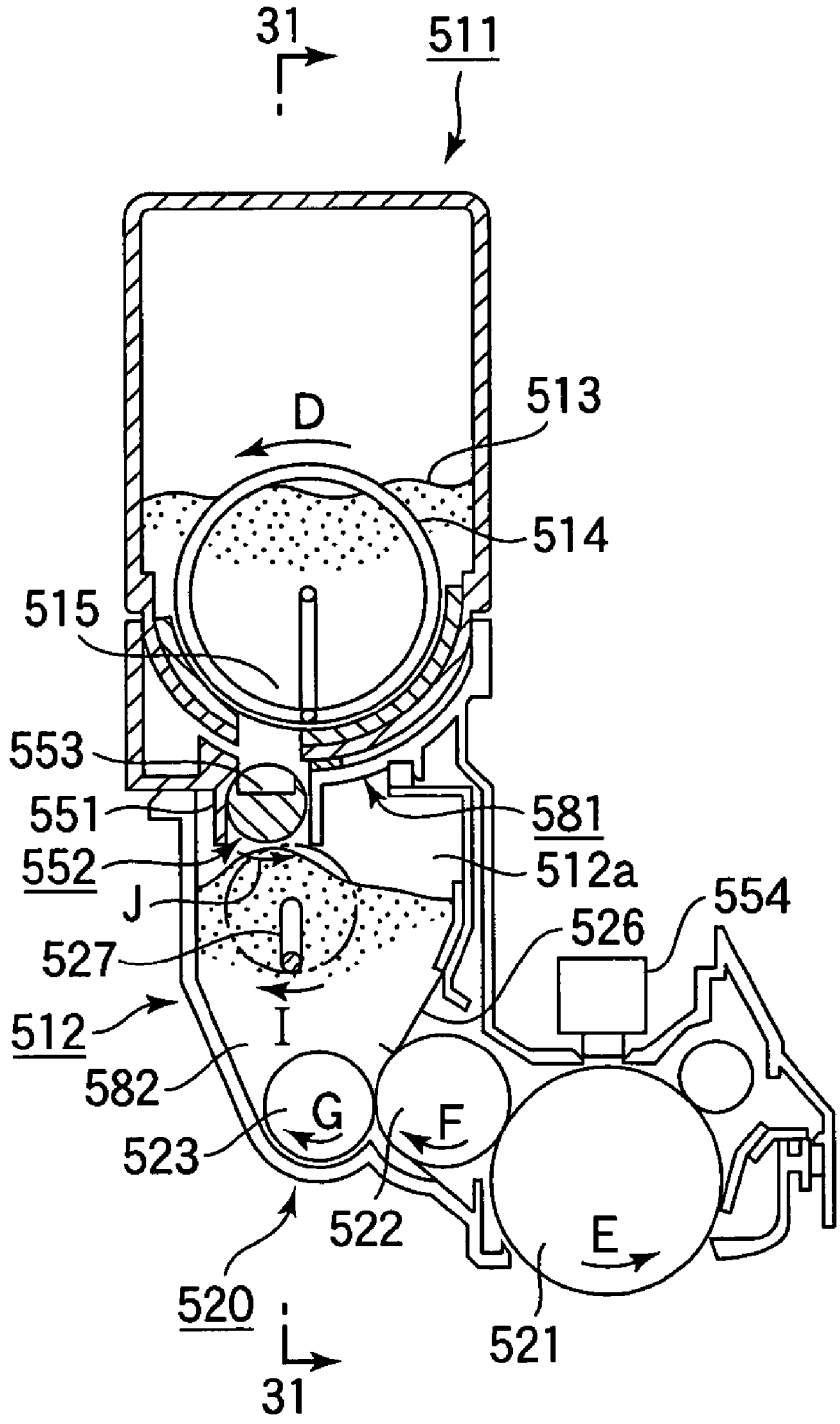
FIG. 30 is a cross-sectional side view of an ID unit according to a fifth embodiment.

FIG. 30 is a cross-sectional side view of an ID unit according to a fifth embodiment.

FIG. 31 is a longitudinal cross-sectional view of the ID unit, taken along lines 31—31 of FIG. 30.

Referring to FIGS. 30 and 31, a process cartridge 512 has a receiving section 581 that receives the toner cartridge 511. The receiving section 581 is formed with an opening 551 in which a rotary valve 552 is rotatably supported and rotates in a direction shown by arrow J. The rotary valve 552 is mounted on a shaft 552*a* (FIG. 31) rotatably supported by the receiving section 581.

The valve 552 is a generally circular cylinder and has a recess 553, which is formed in the valve 552 to extend in a longitudinal direction of the valve 552 and receives a predetermined amount of the toner 513 therein.

A toner reservoir 512*a* holds the toner 513 supplied from the toner cartridge 511. The agitator 527 is rotatable in the toner reservoir 512*a*.

The agitator 527 includes a crank 527*c*, two crank arms 527*g* and 527*h*, a radial projection 527*d*, and rotational shafts 527*e* and 527*f*. The crank 527*c* and the radial projection 527*d* are diametrically oppositely positioned with respect to rotational shafts 527*e*.

Figure 32:
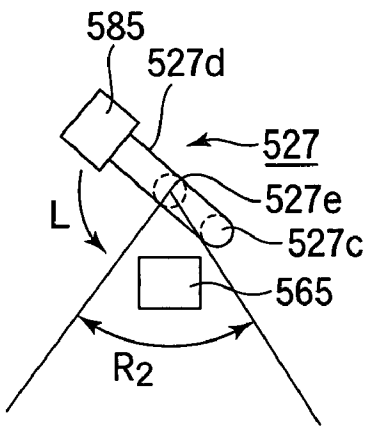
FIG. 32 illustrates a remaining toner detector according to the fifth embodiment as seen in a direction shown by arrow K in FIG. 29 when a process cartridge holds a large amount of toner therein.

FIG. 32 illustrates a remaining toner detector according to the fifth embodiment as seen in a direction shown by arrow K in FIG. 31 when the process cartridge 512 holds a large amount of toner therein.

The radial projection 527*d* has a reflector 585 mounted thereon. A sensor 565 takes the form of a reflection type photo sensor and is disposed on an inner wall 566. When the agitator 527 rotates in a direction shown by arrow L, the reflector 585 passes the front of the sensor 565 to reflect the light emitted from the sensor 565 back to the sensor 565. When the reflector 585 is within a region R2, the reflector 585 reflects the light back to the sensor 565. The reflector 585 and sensor 565 form a remaining toner detector.

Figure 33:
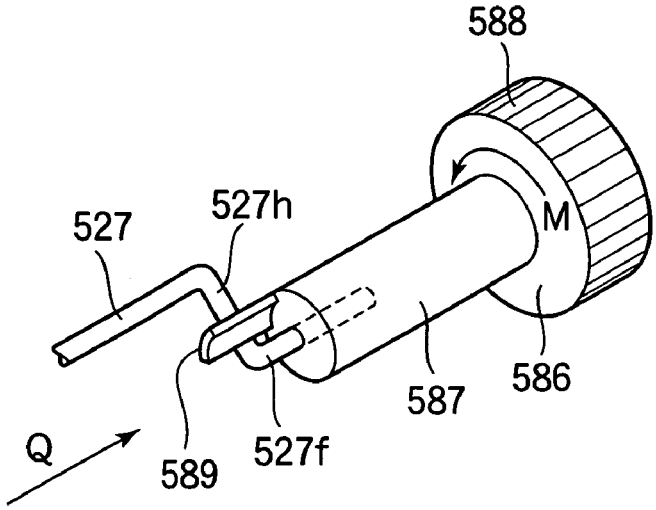
FIG. 33 illustrates an agitator driver that rotates in a direction shown by arrow M to drive an agitator in rotation.

FIG. 33 illustrates an agitator driver 586 that rotates in a direction shown by arrow M to drive the agitator 527 in rotation. The rotational shaft 527*f* of the agitator 527 is rotatably supported in the boss 587. The boss 587 is in one piece with the agitator driver 586 and a projection 589 that projects from the boss 587. A gear 588 is formed in an outer circumferential surface of the agitator driver 586. When the agitator driver 586 rotates in the M direction, the projection 589 engages the crank arm 527*h* to cause the agitator 527 to rotate together with the agitator driver 586. The gear 588 is in mesh with a gear 522*a* mounted on a developing roller 522 (FIG. 31), so that the agitator 527 rotates in synchronism with the developing roller 522.

The rotational shaft 552*a* has a gear 552*b* attached at one longitudinal end thereof. A spiral 514 has a gear 514*a* attached to its one longitudinal end. The gear 514*a* is in mesh with the gear 552*b*, so that the valve 552 and spiral 514 rotate in synchronism. The spiral 514 includes a spiral portion 514*a* and a spiral portion 514*b* that spiral in opposite directions and are connected to each other through a connection 514*c*. When the spiral 514 rotates, the spiral 514 pushes the toner 513 in the toner cartridge 511 to move in the arrows N and O toward the middle portion of the toner cartridge 511.

Figure 34:
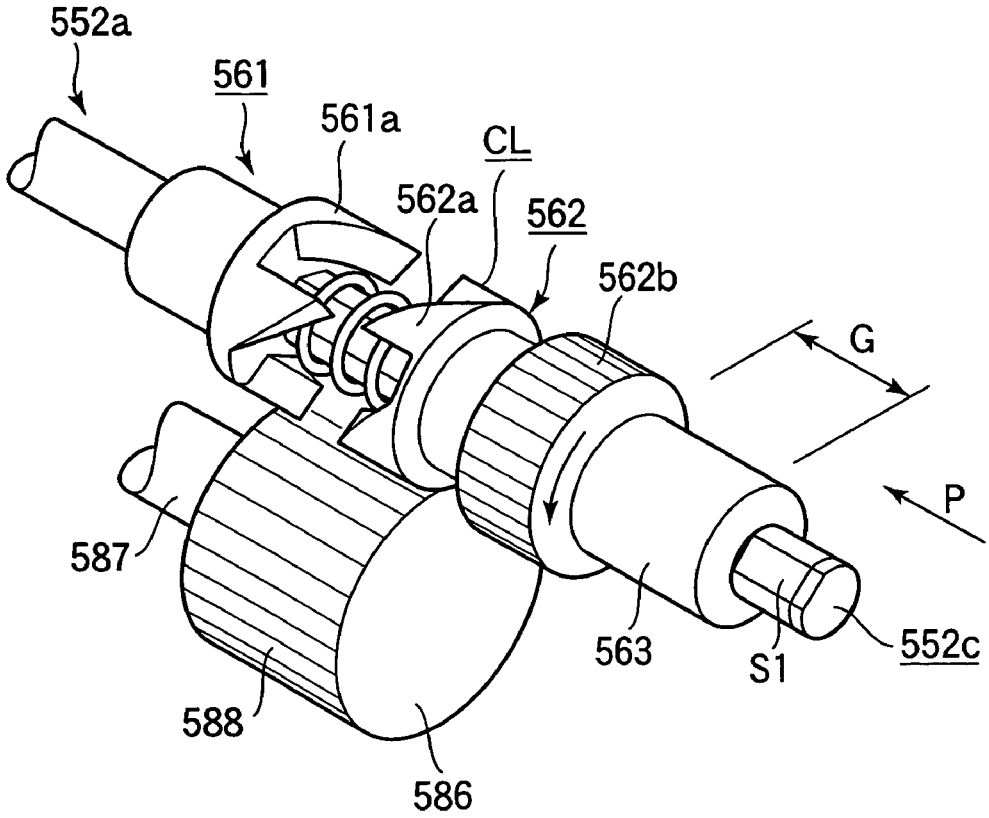
FIG. 34 illustrates a clutch CL according to the third embodiment.

FIG. 34 illustrates a clutch CL according to the third embodiment. A clutch CL is disposed at another longitudinal end of the shaft 552*a*. An end portion of the shaft 552*a* is cut by a plane parallel to the rotational axis of the shaft 552*a*, thereby forming a mounting portion 552*c* having a flat surface S1 and a D-shaped cross section. The clutch CL includes a drive member 562, a driven member 561, and a spring 567 which are mounted on the mounting portion 552*c*.

The driven member 561 has engagement teeth 561*a* and the drive member 562 has another engagement teeth 562*a*. The driven member 561 is firmly fixed to the shaft 552*a* while the drive member 562 is slidable on the mounting portion 552*c*. The drive member 562 has a gear 562*b* and a projection 563 that project from the gear 562*b*. The engagement teeth 561*a* and 562*a* are urged by the spring 567 in such a direction that the engagement teeth 561*a* and 562*a* tend to move away from each other. When the projection 563 is pushed in a direction shown by arrow P, the drive member 562 moves by a distance G toward the driven member 561 against the urging force of the spring 567, so that the engagement teeth 562*a* move into engagement with the engagement teeth 561*a* and the gear 562*b* moves into meshing engagement with the gear 588 of the agitator driver 586. When the gear 562*b* is driven by the gear 588 to rotate in a direction show by arrow R, the clutch CL drives the shaft 552*a* to rotate.

The fifth embodiment has the control block (FIG. 25) for a printer as the fourth embodiment. The operation of the printer of the aforementioned configuration will be described with reference to FIG. 25 and FIG. 30. The controller 440 performs the processing required for printing. That is, the controller 440 issues a print-initiating signal to drive a toner supplying motor, not shown, thereby causing the toner supplying roller 523 to rotate in the G direction to supply the toner 513 to the developing roller 522. The controller 440 also drives a developing motor, not shown, to rotate the developing roller 522 in the F direction so that the toner 513 is deposited on the surface of the photoconductive drum 521. At this moment, the developing blade 526 forms a thin layer of the toner 513 on the developing roller 522 and causes the toner 513 to be charged.

Then, a print head 554 illuminates the charged surface of the photoconductive drum 521 to selectively dissipate the charges on the photoconductive drum 521, so that the potential of the illuminated areas decreases to nearly 0 volts to form an electrostatic latent image as a whole. As the photoconductive drum 521 rotates in the E direction, the electrostatic latent image on the photoconductive drum 521 is brought into contact with the developing roller 522 so that the toner 513 is transferred to the photoconductive drum 521 to develop the electrostatic latent image into a toner image.

FIGS. 35A–35D illustrate various positions of the agitator 527 as seen in a direction shown by arrow Q in FIG. 33 when the process cartridge 512 holds a large amount of toner therein.

Figure 36:
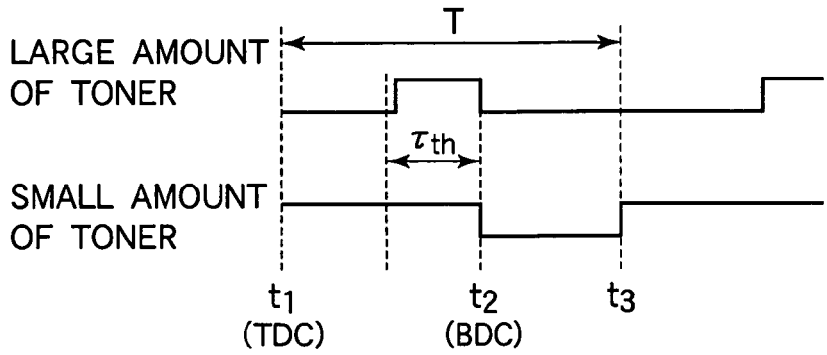
FIG. 36 is a timing chart illustrating the operation of the agitator.

FIG. 36 is a timing chart illustrating the operation of the agitator 527.

Figure 35A:
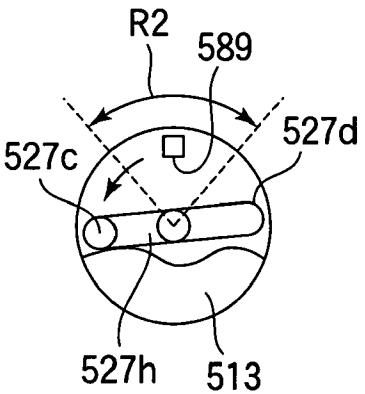
FIGS. 35A–35D illustrate various positions of the agitator as seen in a direction shown by arrow Q in FIG. 31 when the process cartridge holds a large amount of toner therein.
Figure 35B:
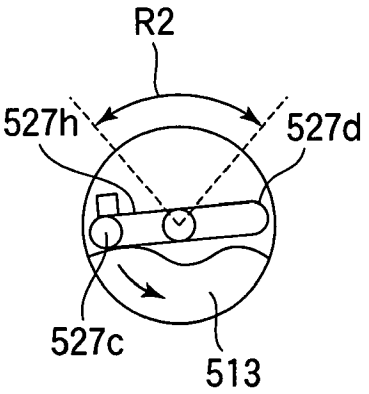

When the toner chamber 582 holds a sufficient amount of toner therein, the agitator 527 operates as follows: The projection 589 of the agitator driver 586 rotates at a fixed rotational speed about the rotational shaft 527*f*, pushing the crank arm 527*h*. Thus, the agitator 527 rotates together with the crank arm 527*h* at the same rotational speed. When the agitator 527 rotates past its top dead center (TDC) at time t1, the agitator 527 drops to rotate freely by its weight to land on the toner 513 as shown in FIG. 35A. Then, the agitator 527 stays there until the projection 589 rotates to again push the crank arm 527*h* as shown in FIG. 35B. At this moment, the radial projection 527*d* has not entered the region R2 in which the sensor 565 detects the reflector 585. Therefore, the output light of the sensor 565 is not reflected back by the reflector 585 and the detection signal is a low level.

When the projection 589 reaches the crank arm 527*h* at time t2, the projection 589 rotates together with the agitator 527, pushing the crank arm 527*h*.

Figure 35C:
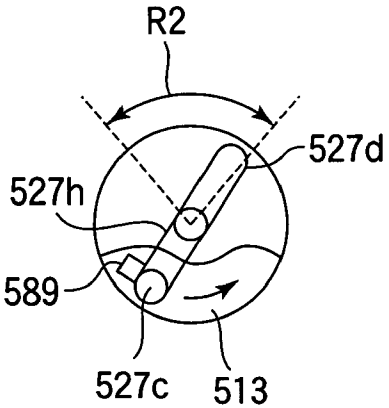

Thereafter, when the radial projection 527*d* enters the region R2 as shown in FIG. 35C, the output light of the sensor 565 is reflected by the reflector 585 and the detection signal is a high level.

The projection 589 continues to rotate pushing the crank 527*c*. When the radial projection 527*d* rotates past the bottom dead center so that the radial projection 527*d* moves out of the region R2 as shown in FIG. 35D, the output light of the sensor 565 is reflected by the reflector 585 and the detection signal becomes a high level.

Thereafter, the projection 589 continues to rotate at the fixed speed, pushing the crank 527*c*, until the crank 527*c* reaches the top dead center again at time t3.

T is the time required for the agitator 527 to make one complete rotation. When the agitator 527 has made one complete rotation, calculation can be made to determine a time length during which the detection signal is a high level. If the time length is longer than a predetermined threshold $\tau$th, it is determined that the remaining amount of toner held in the process cartridge 512*a* is small.

Figure 35D:
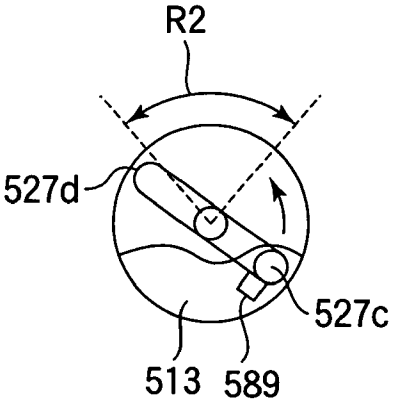

As described above, when the toner chamber 582 holds a sufficient amount of toner therein, the projection 589 pushes the crank arm 527*h* to rotate the crank 527*c* from FIG. 35C position to FIG. 35D position, so that the radial projection 527*d* is within the region R2. Thus, the detection signal of the sensor 565 stays shorter in a high level than in a low level.

FIGS. 37A–37D illustrate the agitator 527 when the process cartridge 512 holds a small amount of toner therein.

Figure 37A:
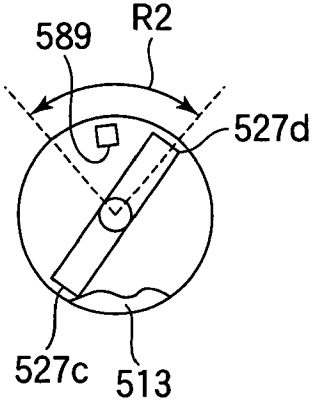
FIGS. 37A–37D illustrate the agitator when the process cartridge holds a small amount of toner therein.

When the toner chamber 582 holds a small amount of toner therein, the projection 589 pushes the crank arm 527*h* to rotate the crank 527*c* until the crank 527*c* reaches its top dead center. When the crank 527*c* rotates past its top dead center, the crank 527*c* drops to rotate freely by its weight to land on the toner 513 as shown in FIG. 37A. The radial projection 527*d* enters the region R2 so that the output light of the sensor 565 is reflected back by the reflector 585. Thus the detection output of the sensor 565 is a high level.

Figure 37B:
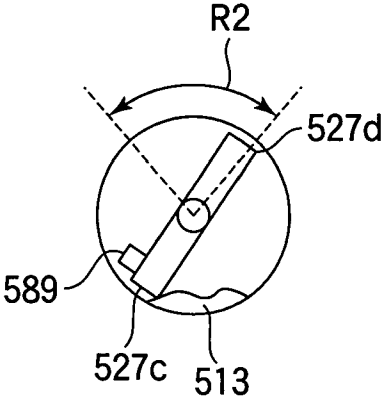

Then, as shown in FIG. 37B, the agitator 527 remains stationary on the toner 513 until the projection 589 reaches the crank arm 527*h* again.

When the projection 589 reaches the crank arm 527*h*, the projection 589 pushes the crank arm 527*h* so that the agitator 527 rotates together with the projection 589 again.

Figure 37C:
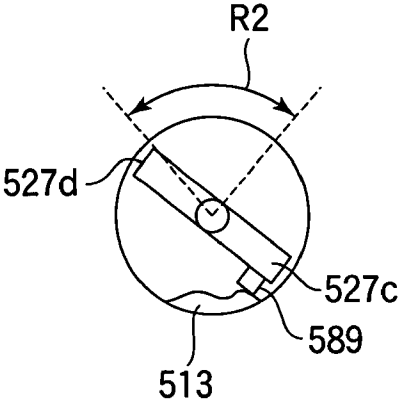

Then, as shown in FIG. 37C, when the radial projection 527*d* moves out of the region R2, i.e., the reflector 585 moves out of the region R2 (FIG. 32), the output light of the sensor 565 is no longer reflected back by the reflector 585. As a result, the detection output of the sensor 565 is a low level.

Figure 37D:
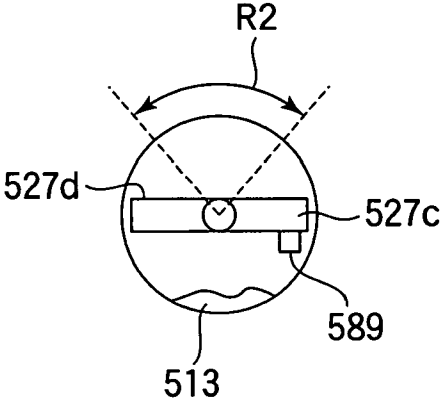

Then, as shown in FIG. 37D, the projection 589 rotates at a fixed speed, while also pushing the crank 527*c* to rotate together toward the top dead center of the crank 527. The output light of the sensor 565 is reflected back by the reflector 585 and the detection output of the sensor 565 is a high level.

Thereafter, the projection 589 continues to rotate at the fixed speed, pushing the crank arm 527*h* until the crank 527*c* reaches its top dead center at the time t3.

As described above, when the toner chamber 582 holds a small amount of toner therein, the radial projection 527*d* is within the region R2 as long as the crank 527 is somewhere from FIG. 35A position to FIG. 35C position. Thus, the detection signal of the sensor 565 stays longer in a high level than in a low level.

The controller 540 reads the detection signal of the sensor 565 to determine a time length (i.e., duration) of a high level and a low level by means of a timer, not shown, thereby detecting a toner-low condition.

Upon detecting a toner-low condition, the controller 440 causes the projection 563 to displace by a distance G, so that the clutch CL engages. Thus, the rotation of the developing motor is transmitted to the shaft 552*a* through gears 522*a*, 588, and 562*b*, and the clutch CL, thereby causing the developing roller 522 to rotate in the F direction, the agitator 527 to rotate in the I direction, and the valve 552 to rotate in the J direction. As a result, the toner 513 held in the toner cartridge 511 is supplied into the process cartridge 512.

Because the gears 552*b* and 514*a* are in mesh with each other, the valve 552 and the transport spiral 514 rotate in synchronism, so that the toner 513 moves toward the toner outlet 515 in the arrows N and O in the toner cartridge 511. Thus, no shortage of toner occurs near the toner outlet 515. Regardless of the remaining amount of toner, the valve 552 can supply about 100 mg of toner 513 per one complete rotation.

When the projection 563 is displaced back in a direction away from the toner cartridge 511, the urging force of the spring 567 causes the drive member 562 to move away from the driven member 561, so that the clutch CL disengages. Thus, the valve 552 stops rotating, terminating supply of toner 513 from the toner cartridge 511 into the process cartridge 512.

Table 7 lists evaluation results of blurring images for different print duties, and the number of pages of continuous printing, replenishment amounts of T of toner 513 per one complete rotation of the valve 552. The replenishment amount can be changed by properly selecting the size of the groove 553.

TABLE 7

| REPLENISHMENT AMOUNT "T" OF TONER (mg) | PRINT DUTY (%) 5 (1 page) | 50 (1 page) | 100 (1 page) | 100 (3 pages) |
|---|---|---|---|---|
| 0 | OCCURRED | OCCURRED | OCCURRED | OCCURRED |
| 25 | NONE | NONE | OCCURRED | OCCURRED |
| 50 | NONE | NONE | NONE | OCCURRED |
| 75 | NONE | NONE | NONE | OCCURRED |
| 100 | NONE | NONE | NONE | NONE |
| 150 | NONE | NONE | NONE | NONE |

Table 7 reveals that when the valve 552 supplies more than 100 mg of toner per one complete rotation, no blurring occurs for printing operations at any print duty. In other words, printing can be performed at a print duty of 5% on about 60 pages of A4 size paper and not more than 3 pages of A4 size paper at a print duty of 100%. If the valve 552 makes more than ⅓ of one complete rotation, a sufficient amount of the toner 513 can be supplied.

As the valve 552 rotates, the transport spiral 514 rotates. When the valve 552 does not rotate, the transport spiral 514 does not rotate, so that the toner 513 held in the toner cartridge 511 is not agitated. This configuration minimizes damage to the toner 513.

Because the valve 552 is mounted on the process cartridge 512 side and not on the toner cartridge 511 side, the valve 552 is not an obstacle when the toner cartridge 511 is attached to or detached from the process cartridge 512. Therefore, the driven member 561 and drive member 562 of the clutch CL can engage and disengage reliably. The valve 552 is a replaceable part. Therefore, it is desirable that the valve 552 includes a minimum number of components for least manufacturing cost of the valve 552. In the present embodiment, a rotational force can be transmitted to the valve 552 through the clutch CL. This configuration reduces the manufacturing cost of the ID unit 520.

Sixth Embodiment

Elements similar to those in the first to fifth embodiments have been given similar reference numerals and the description thereof is omitted.

Figure 38:
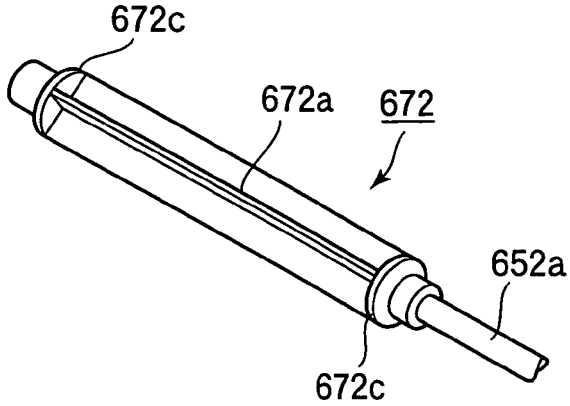
FIG. 38 is a perspective view of a valve according to a sixth embodiment.

FIG. 38 is a perspective view of a valve 672 according to a sixth embodiment.

Figure 39:
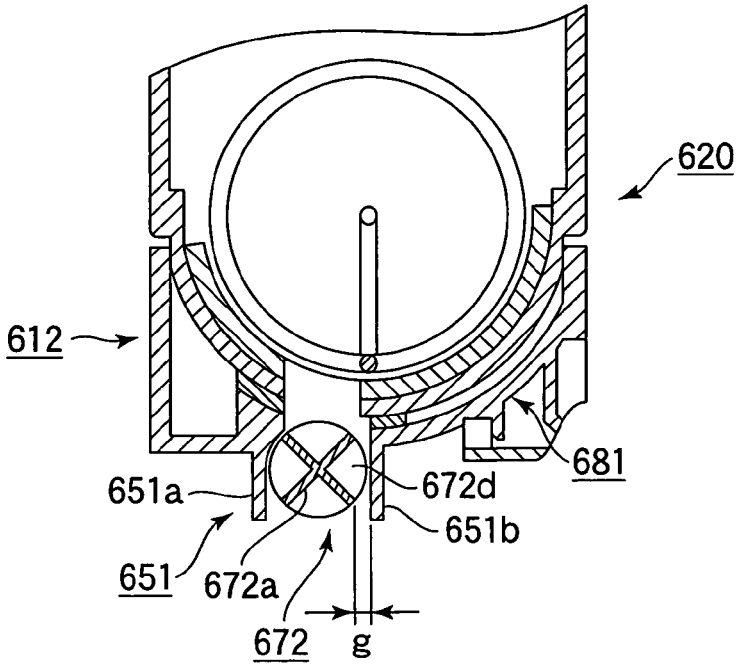
FIG. 39 is a cross sectional view of a pertinent portion of an ID unit according to the sixth embodiment.

FIG. 39 is a cross sectional view of a pertinent portion of an ID unit 620 according to the sixth embodiment.

Figure 40:
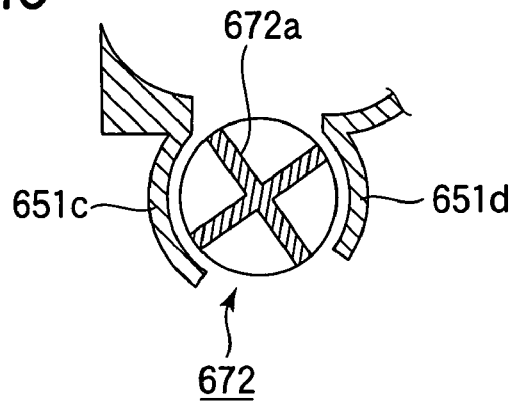
FIG. 40 is a cross-sectional view of a valve of FIG. 38.

FIG. 40 is a cross-sectional view of the valve of FIG. 38.

Referring to FIG. 39, the receiving section 681 is formed with a longitudinally centered toner outlet 651, in which the valve 672 having rotation vanes is rotatably received. The valve 672 is mounted on a longitudinally middle portion of a shaft 52*a* rotatably supported by the receiving section 681. The valve 672 includes flanges 672*c* mounted at longitudinal ends of the valve 672 and four vanes 672*a* that are angularly equally spaced and extend between the flanges 672*c*.

The toner outlet 651 extends along the valve 672 and is defined by opposed walls 651*a* and 651*b*. The walls receive the valve 672 therebetween in a sandwiched relation. The walls 651*a* and 651*b* extend in parallel to each other along the length of the valve 672.

When the valve 672 rotates, the toner 613 in the toner cartridge 611 enters a space 672*d* defined by adjacent vanes 672*a* and moves downward as the valve 672 rotates, thereby being supplied into the process cartridge 612. When the valve 672 is stopped, the replenishment of toner 613 into the process cartridge 612 is terminated.

When the valve 672 is at a rotational position such that when the diametrically opposite vanes 672*a* are horizontal, the gaps g between the vanes and the walls 651*a* and 651*b* are minimum. When the valve 672 is at a rotational position such that the diametrically opposite vanes 672*a* are 45 degrees with respect to a vertical or horizontal axis, the gaps g between the vanes and the walls 651*a* and 651*b* are maximum. In the sixth embodiment, the gap g is selected not to be larger than 2 mm.

Table 8 illustrates evaluation results of the replenishment amount of toner (supply of toner) into the process cartridge 612, and the shutter effect of the valve 672.

TABLE 8

| ΔG (mm) | SUPPLY OF TONER (g) | SHUTTER EFFECT |
|---|---|---|
| 0.5 | 0.1 | GOOD |
| 1 | 0.3 | GOOD |
| 2 | 0.5 | GOOD |
| 3 | 3 | FAIL |
| 4 | 5 | FAIL |

The results in Table 8 were obtained with the following conditions.

(1) Amount of toner remaining in the toner cartridge 611: 500 grams (2) Length of the toner outlet 51: about 70 mm (3) Vibration exerted on the process cartridge 612: 100 times Table 8 reveals that a gap g not larger than 2 mm provides good shutter effect under more serious conditions than the normal operating condition.

The configuration of the sixth embodiment improves shutter effect of the valve 672, preventing an excessive amount of the toner 613 from being supplied into the process cartridge 612. Therefore, there will be no leakage of the toner 613 from the process cartridge 612 which would otherwise occur due to pressure exerted on the sealing member 631.

As shown in FIG. 40, the walls 651*c* and 651*d* may be formed to project downwardly describing circumferential, concave inner surfaces, thereby partially enclosing the valve 672. This configuration provides a smaller gap g.

Modifications to the valve 672 will be described.

FIGS. 41–44 are cross-sectional views of various modifications to the valve 672.

The modifications in FIGS. 41–44 are all generally circular cylinders. When the circular cylinders rotate, the vanes form a cylinder having a diameter not more than 15 mm. The adjacent vanes define grooves A1–A24. The modified valve 673 in FIG. 41 has large bottoms 672*b* formed in every other groove so that the groove having the larger bottom 672*b* is shallow.

Figure 42:
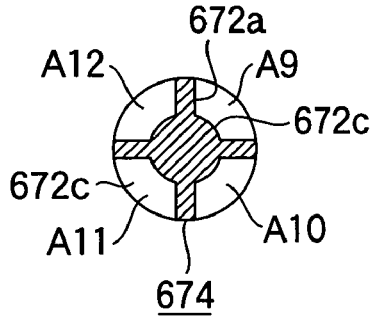
Figure 43:
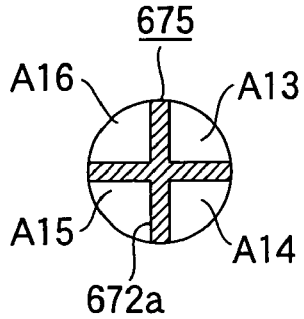
Figure 44:
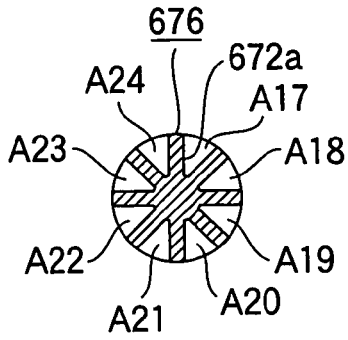

FIG. 42 shows a modified valve 674 that has a large bottom 672*c* in every groove. FIG. 43 illustrates a modified valve 675 that has thicker vanes than those in FIG. 39. FIG. 44 illustrates a modified valve 676 having a larger number of vanes than the valve 672 in FIG. 38.

Table 9 illustrates the relation between the ratio of volume of each groove to the entire volume of a cylinder described when the valve 672 rotates. In Table 9, ρ is given by $\rho=(Q2/Q1)\times100(\%)$, where Q1 is the cross section of the circular cylinder described by the vanes when the valve rotates and Q2 is a sum of cross sectional areas of the grooves.

TABLE 9

Figure 41:
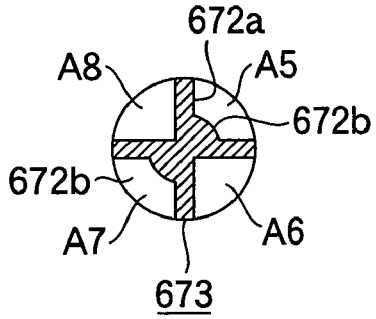
FIGS. 41–44 are cross-sectional views of various modifications to the valve.

| TYPE OF VALVE | ρ (%) | 20° C., 50% R.H. 100 mg/rotation | HIGH R.H./ HIGH TEMP. 100 mg/rotation |
|---|---|---|---|
| FIG. 39 | 80 | SATISFACTORY | SATISFACTORY |
| FIG. 41 | 70 | SATISFACTORY | SATISFACTORY |
| FIG. 42 | 63 | SATISFACTORY | FAIL |
| FIG. 43 | 60 | FAIL | FAIL |
| FIG. 44 | 57 | FAIL | FAIL |

Table 9 shows that when printing is performed at 20° C., 50% R.H, the valves in FIGS. 39, 41, and 42 are capable of supplying 100 mg toner per one complete rotation of the valve.

Table 9 also shows that when printing is performed in a high-temperature and high-humidity environment, the valves in FIGS. 39 and 41 are capable of supplying 100 mg toner per one complete rotation of the valve while the valves in FIGS. 42–44 are not capable of supplying 100 mg toner per one complete rotation of the valve. Thus, for values of ρ not less than 70%, a sufficient amount of the toner can be supplied into the process cartridge 612 reliably.

The modified valve 673 in FIG. 41 will be described.

Figure 45:
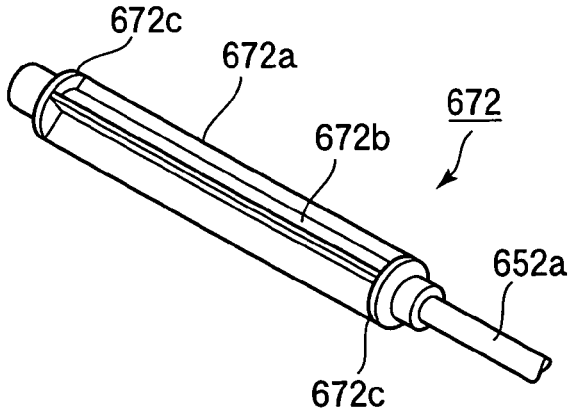
FIG. 45 is a perspective view of the modified valve in FIG. 41.

FIG. 45 is a perspective view of the modified valve 673 in FIG. 41.

Figure 46:
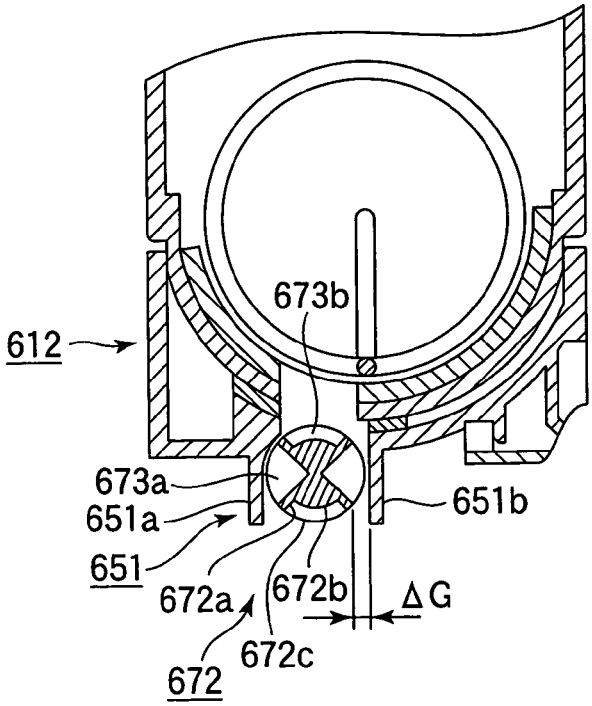
FIG. 46 illustrates a cross-sectional view of a pertinent portion of an ID unit that employs the modified valve.

FIG. 46 illustrates a cross-sectional view of a pertinent portion of the ID unit that employs the modified valve 673.

As described previously, the valve 673 has large diameter center portions such that the valve 673 has a shallow convex bottom 672*b* in every other groove. Grooves A6 and A8 having a cross section of ¼ circle and grooves A5 and A7 having a sector-shaped cross section are alternately positioned angularly.

This configuration adds rigidity to the modified valve 673, preventing the modified valve 673 from deforming.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-forming apparatus comprising:

a first casing holding developer therein;

a second casing to which said first casing is detachably attached, said second casing having a developer reservoir that holds the developer supplied from said first casing;

an image-bearing body and a developer-bearing body that supplies the developer to the image-bearing body; and a developer supplying member that is located between said first casing and said second casing and supplies the developer from said first casing to said second casing;

wherein when said developer-supplying member operates, said developer-supplying member supplies a volume of the developer in such a way that the developer in the developer reservoir is not more than a predetermined fraction of a maximum capacity of the developer reservoir;

wherein the predetermined fraction is 80% of the maximum capacity of the developer reservoir.

2. The image-forming apparatus according to claim 1, wherein said second casing has a detector that detects a remaining amount of developer held in the developer reservoir.

3. The image-forming apparatus according to claim 2, wherein the detector detects when a remaining amount of the developer fills not more than 80% of a total capacity of the developer reservoir.

4. The image-forming apparatus according to claim 3, wherein said second casing includes a developer-agitating member that agitates the remaining amount of the developer that fills not more than 80% of a total capacity of the developer reservoir.

5. An image-forming apparatus comprising:

a first casing holding developer therein;

a second casing to which said first casing is detachably attached, said second casing having a developer reservoir that holds the developer supplied from said first casing;

an image-bearing body and a developer-bearing body that supplies the developer to the image-bearing body; and a developer supplying member that is located between said first casing and said second casing and supplies the developer from said first casing to said second casing;

wherein when said developer-supplying member operates, said developer-supplying member supplies a volume of the developer in such a way that the developer in the developer reservoir is not more than a predetermined fraction of a maximum capacity of the developer reservoir;

wherein said developer-supplying member is selectively operatively coupled to the developer bearing body;

wherein when said developer-supplying member is coupled to the developer-bearing body, rotation of the developer-bearing body is transmitted to said developer-supplying member; and wherein when said developer-supplying member is not coupled to the developer-bearing body, rotation of the developer-bearing body is not transmitted to said developer-supplying member.

6. An image-forming apparatus comprising:

a first casing holding developer therein;

a second casing to which said first casing is detachably attached, said second casing having a developer reservoir that holds the developer supplied from said first casing;

an image-bearing body and a developer-bearing body that supplies the developer to the image-bearing body; and a developer supplying member that is located between said first casing and said second casing and supplies the developer from said first casing to said second casing;

wherein when said developer-supplying member operates, said developer-supplying member supplies a volume of the developer in such a way that the developer in the developer reservoir is not more than a predetermined fraction of a maximum capacity of the developer reservoir;

wherein when said developer-supplying member operates, said developer-supplying member supplies an amount of the developer at a rate not more than 10W, where W is an amount of the developer consumed per second when printing is being performed on a print medium at a print duty of 100%.

7. The image-forming apparatus according to claim 6, wherein said second casing has a detector that detects a remaining amount of developer in the developer reservoir.

8. The image-forming apparatus according to claim 6, wherein said second casing includes a developer-agitating member that agitates the developer held in the developer reservoir.

9. The image-forming apparatus according to claim 6, wherein the amount T of the developer is such that $2W \leqq T \leqq 10W$.

10. An image-forming apparatus comprising:

a first casing holding developer therein;

a second casing to which said first casing is detachably attached, said second casing having a developer reservoir that holds the developer supplied from said first casing;

an image-bearing body and a developer-bearing body that supplies the developer to the image-bearing body; and a developer supplying member that is located between said first casing and said second casing and supplies the developer from said first casing to said second casing;

wherein when said developer-supplying member operates, said developer-supplying member supplies a volume of the developer in such a way that the developer in the developer reservoir is not more than a predetermined fraction of a maximum capacity of the developer reservoir;

wherein when said developer-supplying member operates, said developer-supplying member rotates to supply the developer by at least 100 mg for each complete rotation of said developer-supplying member.

11. The image-forming apparatus according to claim 10, wherein said first casing has a developer-transporting member rotatably supported therein to transport the developer toward a middle portion of said first casing;

wherein the developer-transporting member is operatively coupled to said developer supplying member so that rotation of said developer supplying member is transmitted to the developer-transporting member.

12. The image-forming apparatus according to claim 6, wherein said developer-supplying member extends in a longitudinal direction and has a plurality of vanes;

wherein the plurality of vanes extend in a direction substantially parallel to the longitudinal direction and in a direction transverse to the longitudinal direction to define a developer-holding space between adjacent vanes.

13. The image-forming apparatus according to claim 12, wherein the developer-holding space is in the relation that $$70 \leqq (Q2/Q1) \times 100$$

where Q2 is a sum of cross-sectional areas of the developer-holding space extending in a plane perpendicular to the longitudinal direction, and Q1 is a cross-sectional area of a circular cylinder described by the plurality of vanes when said developer supplying member rotates about an axis parallel to the longitudinal direction.

14. The image-forming apparatus according to claim 12, wherein said second casing has opposing walls that define an opening therebetween in which said developer supplying member is rotatably received with a gap not more than 2 mm between each one of the walls and the vanes.

15. The image-forming apparatus according to claim 12, wherein the developer-holding space is one of a plurality of developer-holding spaces and at least one of the plurality of developer-holding spaces has a different cross-sectional area from the other ones of the plurality of developer-holding spaces.

16. The image-forming apparatus according to claim 10, wherein said developer-supplying member extends in a longitudinal direction and has a plurality of vanes; and wherein the plurality of vanes extend in a direction substantially parallel to the longitudinal direction and in a direction transverse to the longitudinal direction to define a developer-holding space between adjacent vanes.

17. The image-forming apparatus according to claim 16, wherein the developer-holding space is in the relation that $$70 \leqq (Q2/Q1) \times 100$$

where Q2 is a sum of cross-sectional areas of the developer-holding space extending in a plane perpendicular to the longitudinal direction, and Q1 is a cross-sectional area of a circular cylinder described by the plurality of vanes when said developer supplying member rotates about an axis parallel to the longitudinal direction.

18. The image-forming apparatus according to claim 16, wherein said second casing has opposing walls that define an opening therebetween in which said developer supplying member is rotatably received with a gap not more than 2 mm between each one of the walls and the vanes.

19. The image-forming apparatus according to claim 16, wherein the developer-holding space is one of a plurality of developer-holding spaces and at least one of the plurality of developer-holding spaces has a different cross-sectional area from the other ones of the plurality of developer-holding spaces.

* * * * *